US008506374B1

(12) United States Patent
Cleghorn

(10) Patent No.: US 8,506,374 B1
(45) **Date of Patent: *Aug. 13, 2013**

(54) LETTER PLACEMENT GAME

(76) Inventor: Jefferson W. Cleghorn, Brookline, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/613,625

(22) Filed: Sep. 13, 2012

Related U.S. Application Data

(63) Continuation of application No. 13/407,966, filed on Feb. 29, 2012, now Pat. No. 8,308,539.

(51) Int. Cl.
*A63F 9/24* (2006.01)
*A63F 13/00* (2006.01)

(52) U.S. Cl.
USPC ..... 463/11; 463/9; 434/159; 434/167; 434/176

(58) Field of Classification Search
USPC ..... 463/9, 11
See application file for complete search history.

(56) References Cited

U.S. PATENT DOCUMENTS

| | | | | | |
|---|---|---|---|---|---|
| 4,205,852 | A * | 6/1980 | Wayman | 273/272 |
| 4,299,578 | A * | 11/1981 | Wayman | 434/177 |
| 5,566,942 | A * | 10/1996 | Elum | 273/153 R |
| 5,813,672 | A * | 9/1998 | Loud, Jr. | 273/272 |
| 5,921,864 | A * | 7/1999 | Walker et al. | 463/9 |
| 6,340,159 | B1 * | 1/2002 | Giangrante | 273/272 |
| 6,386,880 | B2 * | 5/2002 | Bryant | 434/188 |
| 7,458,580 | B2 * | 12/2008 | Martineck et al. | 273/139 |
| 7,591,469 | B2 * | 9/2009 | Dowe | 273/272 |
| 7,644,924 | B2 * | 1/2010 | Horowitz | 273/153 S |
| 7,677,564 | B2 * | 3/2010 | Kriger | 273/148 R |
| 7,677,570 | B2 * | 3/2010 | Hohenstein et al. | 273/271 |
| 7,887,055 | B2 * | 2/2011 | Gardner | 273/153 R |
| 7,907,779 | B2 * | 3/2011 | Kawamoto et al. | 382/187 |
| 2004/0195765 | A1 * | 10/2004 | Bellefleur | 273/153 R |
| 2007/0177801 | A1 * | 8/2007 | Kawamoto et al. | 382/187 |
| 2009/0198576 | A1 * | 8/2009 | Rogers, Jr. | 705/14 |
| 2009/0275372 | A1 * | 11/2009 | Prucey | 463/9 |
| 2010/0156045 | A1 * | 6/2010 | Kahn et al. | 273/153 R |
| 2011/0190053 | A1 * | 8/2011 | Kawamoto et al. | 463/31 |

OTHER PUBLICATIONS

"Introduction to Word Sudoku (Code-Doku)", sourced from http://www.mathrec.org/sudoku/codedokuintro.html, accessed Nov. 9, 2010.*

"Wordoku Solver", sourced from http://sudoku-solutions.com/wordokuSolver9b9.php, accessed Dec. 20, 2010.*

"Wordoku Unbound #1 (Letter Sudoku Puzzles for Kindle)", created by the Puzazz Company, Sourced from http://www.amazon.com/Wordoku-Unbound-1 /dp/B004EIJP1E/ref=sr_1_1?ie=UTF8&qid=1338493981&sr=8-1 Reviews describing game features dated Dec. 2010.*

"ABCDoqu", by Cleghorn, Jefferson W. http://www.abcdoqu.com, 15 pages (2009).*

* cited by examiner

*Primary Examiner* — Steven J Hylinski
(74) *Attorney, Agent, or Firm* — J. Scott Southworth

(57) ABSTRACT

A letter placement game based on solving for missing characters in empty cells in a grid of characters. The grid includes horizontal rows, vertical rows, and subgrids. Each solution character must be singular in its horizontal row, vertical row, and subgrid. Simultaneously some solution characters must also belong to one or more sets of solution characters (for example, one or more words). Clues are provided for each set of solution characters. Typically, each letter placement game has multiple sets of solution characters. The letter placement game thus has dual sets of requirements, one for singularity rules for every solution character and another for the requirements of sets of solution characters (for example, words).

7 Claims, 14 Drawing Sheets

| Gray Box # | Clue (No. of letters) | Gray Box # | Clue (No. of letters) |
|---|---|---|---|
| 1 | Telepathic TV character (4) | 8 | A measure of pace (4) |
| 2 | spin (5) | 9 | noisy (9) |
| 3 | flatter (6) | 10 | rage (3) |
| 4 | consummate (5) | 11 | A pile (4) |
| 5 | To press for (4) | 12 | Canoe mover (6) |
| 6 | At peace (9) | 13 | "Render __ Caesar" (4) |
| 7 | Theological faction (4) | | |

20 22 24 26 28 32 32 34

| | | | | | | | | | | | | | | | | | | | | | | | | |
|---|---|---|---|---|---|---|---|---|---|---|---|---|---|---|---|---|---|---|---|---|---|---|---|---|
| X | F | I | C | E | Z | V | D | T | S | | | B | K | P | U | H | O | R | G | | L | N | | |
| | N | H | B | A | E | L | C | O | F | D | V | Z | X | W | I | J | P | M | S | U | Y | | | R |
| Z | Y | O | D | J | | P | A | G | M | I | N | H | R | L | V | K | F | T | W | S | C | B | | |
| K | L | M | V | P | W | X | N | Y | R | S | | J | T | U | C | B | A | D | E | | G | F | I | Z |
| R | S | T | U | W | J | K | B | I | H | A | F | G | C | E | Y | Z | L | X | N | | P | D | | O |
| | M | K | S | Y | I | | E | Z | L | | | W | | N | F | D | U | P | V | G | H | R | | J |
| D | W | L | F | X | G | N | T | J | K | P | C | V | A | H | S | M | R | I | | Z | O | E | U | Y |
| H | | R | O | N | X | F | P | V | U | G | L | Y | I | M | Z | W | E | A | | D | S | C | | B |
| P | J | G | Z | C | B | R | Y | A | W | E | S | U | D | K | H | O | X | L | T | M | I | V | F | N |
| V | I | B | E | U | S | H | O | M | D | F | R | X | J | Z | N | | G | Y | | A | T | P | L | W |
| | V | N | K | B | A | | X | L | O | | U | T | | R | J | I | H | Z | P | F | W | S | D | M |
| I | E | C | R | O | N | W | F | U | T | H | D | M | | X | | Y | K | S | A | P | J | Z | B | V |
| W | G | Z | P | H | V | B | M | K | E | J | A | S | Y | I | X | R | C | F | D | N | U | L | O | T |
| M | A | J | L | | Y | D | S | C | Z | K | | F | | V | G | U | N | W | O | R | X | I | H | E |
| S | U | D | X | F | R | I | J | H | | L | W | N | Z | O | E | T | V | B | M | Y | A | G | C | K |
| U | O | P | G | V | | | H | | | M | Z | L | W | F | | S | T | J | R | C | | | Y | I |
| J | H | A | T | S | C | Y | R | D | | N | X | K | V | G | O | P | M | E | L | B | Z | U | W | F |
| N | C | E | Y | K | M | O | U | F | | B | P | I | H | A | | G | Z | V | X | L | R | | S | D |
| L | D | X | M | Z | T | S | W | P | V | R | Y | E | U | C | K | F | B | H | I | O | N | | A | G |
| B | R | F | W | I | L | | Z | X | G | T | J | O | S | D | A | N | Y | C | | K | V | M | P | H |
| O | | | | M | H | Z | I | E | A | U | | C | F | S | | X | D | K | Y | | B | W | N | |
| T | Z | | A | R | O | U | K | W | Y | V | I | D | L | B | P | E | J | N | F | X | M | H | G | C |
| C | B | Y | H | L | D | M | G | S | | W | K | R | N | J | T | A | I | U | Z | E | F | O | V | P |
| F | K | | N | G | P | J | V | R | C | X | E | A | M | T | B | L | S | O | H | I | D | Y | Z | U |
| E | X | U | I | D | | T | L | N | B | Z | H | | O | Y | M | V | W | G | C | J | K | A | R | S |

32 30 36

FIG. 1

40

42

| | | | | | | | | | | | | | | | | | | | | | | | | |
|---|---|---|---|---|---|---|---|---|---|---|---|---|---|---|---|---|---|---|---|---|---|---|---|---|
| X | F | I | C | E | Z | V | D | T | S | Y | M | B | K | P | U | H | O | R | G | W | L | N | J | A |
| G | N | H | B | A | E | L | C | O | F | D | V | Z | X | W | I | J | P | M | S | U | Y | K | T | R |
| Z | Y | O | D | J | U | P | A | G | M | I | N | H | R | L | V | K | F | T | W | S | C | B | E | X |
| K | L | M | V | P | W | X | N | Y | R | S | O | J | T | U | C | B | A | D | E | H | G | F | I | Z |
| R | S | T | U | W | J | K | B | I | H | A | F | G | C | E | Y | Z | L | X | N | V | P | D | M | O |
| A | M | K | S | Y | I | C | E | Z | L | O | T | W | B | N | F | D | U | P | V | G | H | R | X | J |
| D | W | L | F | X | G | N | T | J | K | P | C | V | A | H | S | M | R | I | B | Z | O | E | U | Y |
| H | T | R | O | N | X | F | P | V | U | G | L | Y | I | M | Z | W | E | A | J | D | S | C | K | B |
| P | J | G | Z | C | B | R | Y | A | W | E | S | U | D | K | H | O | X | L | T | M | I | V | F | N |
| V | I | B | E | U | S | H | O | M | D | F | R | X | J | Z | N | C | G | Y | K | A | T | P | L | W |
| Y | V | N | K | B | A | G | X | L | O | C | U | T | E | R | J | I | H | Z | P | F | W | S | D | M |
| I | E | C | R | O | N | W | F | U | T | H | D | M | G | X | L | Y | K | S | A | P | J | Z | B | V |
| W | G | Z | P | H | V | B | M | K | E | J | A | S | Y | I | X | R | C | F | D | N | U | L | O | T |
| M | A | J | L | T | Y | D | S | C | Z | K | B | F | P | V | G | U | N | W | O | R | X | I | H | E |
| S | U | D | X | F | R | I | J | H | P | L | W | N | Z | O | E | T | V | B | M | Y | A | G | C | K |
| U | O | P | G | V | K | A | H | B | N | M | Z | L | W | F | D | S | T | J | R | C | E | X | Y | I |
| J | H | A | T | S | C | Y | R | D | I | N | X | K | V | G | O | P | M | E | L | B | Z | U | W | F |
| N | C | E | Y | K | M | O | U | F | J | B | P | I | H | A | W | G | Z | V | X | L | R | T | S | D |
| L | D | X | M | Z | T | S | W | P | V | R | Y | E | U | C | K | F | B | H | I | O | N | J | A | G |
| B | R | F | W | I | L | E | Z | X | G | T | J | O | S | D | A | N | Y | C | U | K | V | M | P | H |
| O | P | V | J | M | H | Z | I | E | A | U | G | C | F | S | R | X | D | K | Y | T | B | W | N | L |
| T | Z | S | A | R | O | U | K | W | Y | V | I | D | L | B | P | E | J | N | F | X | M | H | G | C |
| C | B | Y | H | L | D | M | G | S | X | W | K | R | N | J | T | A | I | U | Z | E | F | O | V | P |
| F | K | W | N | G | P | J | V | R | C | X | E | A | M | T | B | L | S | O | H | I | D | Y | Z | U |
| E | X | U | I | D | F | T | L | N | B | Z | H | P | O | Y | M | V | W | G | C | J | K | A | R | S |

FIG. 2

60

62a 32a 32b 32c 64a 32d

| | | | | | | | | | | | | | | | | | | | | | | | | |
|---|---|---|---|---|---|---|---|---|---|---|---|---|---|---|---|---|---|---|---|---|---|---|---|---|
| F | X | Y | W | T | C | E | M | V | Z | U | D | L | B | R | O | G | H | K | N | J | A | S | P | I |
| N | A | O | I | L | X | P | D | J | K | T | F | Y | S | G | C | R | V | B | E | M | H | Z | W | U |
| M | R | U | E | K | G | Y | N | T | H | O | X | J | I | A | S | Z | W | L | P | D | B | C | F | V |
| C | G | D | B | H | F | I | A | W | S | V | N | Z | E | P | X | T | U | J | M | L | Y | O | R | K |
| J | Z | P | S | V | U | L | B | R | O | W | K | M | H | C | Y | F | A | D | I | E | N | G | T | X |
| I | W | G | A | J | L | M | H | F | D | E | Z | T | U | K | V | C | P | R | S | Y | X | N | B | O |
| D | O | C | U | E | V | J | W | G | P | B | R | S | A | Y | H | N | I | X | F | K | T | L | M | Z |
| H | Y | V | R | Z | A | K | X | S | B | N | C | O | J | M | U | L | E | T | D | I | P | F | G | W |
| L | F | B | K | P | T | U | C | N | R | I | G | H | X | W | Z | Y | M | O | A | V | S | D | J | E |
| T | M | N | X | S | E | Z | Y | O | I | P | L | F | D | V | K | B | G | W | J | R | C | H | U | A |
| U | I | R | T | N | H | G | P | E | J | C | O | W | Z | X | M | K | D | A | B | S | L | Y | V | F |
| W | K | S | G | O | I | X | F | B | M | H | T | A | P | J | L | V | N | E | Y | Z | R | U | C | D |
| X | L | Z | P | A | S | D | K | C | W | R | U | V | Y | B | G | O | J | F | H | T | M | E | I | N |
| V | D | H | J | F | Z | N | U | Y | A | M | I | E | K | L | R | S | T | C | X | P | G | W | O | B |
| Y | B | E | M | C | O | T | R | L | V | D | S | N | G | F | P | U | Z | I | W | X | K | A | H | J |
| Z | J | X | V | M | P | B | L | A | F | S | E | K | R | D | I | W | C | N | O | H | U | T | Y | G |
| B | H | F | L | G | W | O | E | U | T | Z | A | C | M | I | J | P | K | Y | R | N | D | V | X | S |
| E | C | T | Y | W | D | R | V | K | X | G | H | P | F | N | B | A | L | S | U | O | I | J | Z | M |
| A | P | K | O | D | M | S | G | I | N | Y | J | U | W | T | E | H | X | Z | V | B | F | R | L | C |
| S | U | I | N | R | Y | H | J | Z | C | L | B | X | V | O | D | M | F | G | T | A | W | K | E | P |
| K | T | A | D | X | B | W | Z | H | E | F | Y | I | L | U | N | J | O | P | C | G | V | M | S | R |
| R | S | L | F | I | N | V | T | D | U | J | P | G | O | Z | W | X | Y | M | K | C | E | B | A | H |
| G | E | J | Z | B | K | F | S | M | Y | X | W | D | C | H | A | I | R | V | L | U | O | P | N | T |
| O | N | M | C | U | J | A | I | P | L | K | V | R | T | S | F | E | B | H | G | W | Z | X | D | Y |
| P | V | W | H | Y | R | C | O | X | G | A | M | B | N | E | T | D | S | U | Z | F | J | I | K | L |

64d 32e 32f 32g 64b 32h 64c 62b 62c

FIG. 5

110

112

| Gray Box # | Clue (No. of letters) | Gray Box # | Clue (No. of letters) |
|---|---|---|---|
| 1 | Telepathic TV character (4) | 8 | A measure of pace (4) |
| 2 | spin (5) | 9 | noisy (9) |
| 3 | flatter (6) | 10 | rage (3) |
| 4 | consummate (5) | 11 | A pile (4) |
| 5 | To press for (4) | 12 | Canoe mover (6) |
| 6 | At peace (9) | 13 | "Render __ Caesar" (4) |
| 7 | Theological faction (4) | | |

FIG. 10

120

52e 122a 122c 122b

| | | | | | | | | | | | | | | | | | | | | | | | | |
|---|---|---|---|---|---|---|---|---|---|---|---|---|---|---|---|---|---|---|---|---|---|---|---|---|
| O | P | 1 | E | U | X | T | V | D | | L | | Y | I | K | M | A | 2 | | N | F | B | C | J | G |
| M | L | | D | I | U | Y | 3 | B | S | Z | J | O | R | V | T | G | | C | F | E | W | X | N | P |
| W | V | | H | X | | F | Z | | G | M | N | B | S | | K | J | 4 | | | | | U | T | Y |
| | S | | J | Y | | L | M | A | | C | | G | F | U | P | O | | X | B | K | D | Z | V | H |
| F | G | B | K | C | N | J | H | E | P | | W | A | D | X | V | Z | | U | Y | | O | R | M | S |
| E | F | T | P | S | J | K | N | X | | V | | I | U | R | Z | Y | M | W | H | G | C | D | L | B |
| G | K | Y | L | V | D | I | C | | U | N | S | | Z | | A | T | P | B | X | | | O | F | J |
| Z | H | U | C | | O | S | | Y | T | B | G | X | P | F | L | D | | N | K | W | R | I | | |
| R | J | | B | A | L | | | W | V | H | M | K | | Y | S | I | O | F | C | N | U | E | Z | X |
| I | O | X | W | N | | H | | | F | A | C | D | L | J | 5 | | | | V | Y | S | P | K | T |
| | B | I | | | | Z | F | L | K | R | V | M | O | A | | C | T | G | | D | | H | S | N |
| C | R | G | 6 | L | | U | Y | M | O | | D | 7 | H | | N | | K | P | J | V | A | F | | I |
| S | D | K | N | F | 8 | | | | B | W | U | | J | L | O | V | Y | H | | X | Z | | P | C |
| A | Z | M | X | J | R | V | W | H | D | P | F | | G | | I | E | U | L | S | B | Y | T | | K |
| | W | O | V | P | S | N | X | C | J | | Y | | B | I | F | M | Z | A | D | L | E | G | U | R |
| K | N | 9 | | G | Z | R | D | V | H | | L | F | X | T | W | S | | I | U | C | | B | Y | A |
| | E | F | | R | K | W | J | U | C | S | P | | M | G | B | | X | O | Z | T | N | V | 10 | D |
| V | U | H | S | | F | G | O | | Y | E | I | N | W | C | | K | A | J | T | Z | X | L | | M |
| L | | W | I | T | | X | | | M | J | R | | V | | G | H | F | Y | P | U | | S | | O |
| D | X | P | O | Z | T | | L | S | I | Y | K | U | | B | | N | C | V | M | H | F | J | G | W |
| B | M | L | F | O | 11 | C | | G | Z | I | X | 12 | N | S | Y | 13 | V | K | A | J | T | W | D | |
| P | | S | R | K | W | D | U | | | F | T | | E | H | C | X | | | | O | V | A | B | Z |
| X | A | E | Z | D | V | M | P | J | | U | B | L | | O | | W | S | | I | R | G | Y | C | F |
| | I | C | U | H | A | B | T | F | E | | Z | V | Y | W | J | P | D | R | | S | | K | X | |
| J | T | V | G | W | | | S | K | X | D | A | R | C | M | E | F | B | Z | L | P | I | N | | U |

FIG. 11

130

132a 32q 64h 32r 64i 32s 132b 32t

| | | | | | | | | | | | | | | | | | | | | | | | | | |
|---|---|---|---|---|---|---|---|---|---|---|---|---|---|---|---|---|---|---|---|---|---|---|---|---|---|
| O | P | Z | E | U | X | T | V | D | R | L | H | Y | I | K | M | A | W | S | N | F | B | C | J | G | |
| M | L | A | D | I | U | Y | K | B | S | Z | J | O | R | V | T | G | H | C | F | E | W | X | N | P | |
| W | V | R | H | X | C | F | Z | O | G | M | N | B | S | P | K | J | I | D | E | A | L | U | T | Y | |
| T | S | N | J | Y | I | L | M | A | W | C | E | G | F | U | P | O | R | X | B | K | D | Z | V | H | |
| F | G | B | K | C | N | J | H | E | P | T | W | A | D | X | V | Z | L | U | Y | I | O | R | M | S | 32u |
| E | F | T | P | S | J | K | N | X | A | V | O | I | U | R | Z | Y | M | W | H | G | C | D | L | B | |
| G | K | Y | L | V | D | I | C | R | U | N | S | W | Z | E | A | T | P | B | X | M | H | O | F | J | |
| Z | H | U | C | M | O | S | E | Y | T | B | G | X | P | F | L | D | J | N | K | W | R | I | A | V | |
| R | J | D | B | A | L | P | G | W | V | H | M | K | T | Y | S | I | O | F | C | N | U | E | Z | X | |
| I | O | X | W | N | M | H | B | Z | F | A | C | D | L | J | U | R | G | E | V | Y | S | P | K | T | 32v |
| U | B | I | Y | E | P | Z | F | L | K | R | V | M | O | A | X | C | T | G | W | D | J | H | S | N | |
| C | R | G | T | L | E | U | Y | M | O | X | D | S | H | Z | N | B | K | P | J | V | A | F | W | I | |
| S | D | K | N | F | G | A | I | T | B | W | U | E | J | L | O | V | Y | H | R | X | Z | M | P | C | |
| A | Z | M | X | J | R | V | W | H | D | P | F | C | G | N | I | E | U | L | S | B | Y | T | O | K | |
| H | W | O | V | P | S | N | X | C | J | K | Y | T | B | I | F | M | Z | A | D | L | E | G | U | R | 32w |
| K | N | J | M | G | Z | R | D | V | H | O | L | F | X | T | W | S | E | I | U | C | P | B | Y | A | |
| Y | E | F | A | R | K | W | J | U | C | S | P | H | M | G | B | L | X | O | Z | T | N | V | I | D | |
| V | U | H | S | B | F | G | O | P | Y | E | I | N | W | C | D | K | A | J | T | Z | X | L | R | M | |
| L | C | W | I | T | B | X | A | N | M | J | R | Z | V | D | G | H | F | Y | P | U | K | S | E | O | |
| D | X | P | O | Z | T | E | L | S | I | Y | K | U | A | B | R | N | C | V | M | H | F | J | G | W | 32x |
| B | M | L | F | O | H | C | R | G | Z | I | X | P | N | S | Y | U | V | K | A | J | T | W | D | E | |
| P | Y | S | R | K | W | D | U | I | L | F | T | J | E | H | C | X | N | M | G | O | V | A | B | Z | |
| X | A | E | Z | D | V | M | P | J | N | U | B | L | K | O | H | W | S | T | I | R | G | Y | C | F | |
| N | I | C | U | H | A | B | T | F | E | G | Z | V | Y | W | J | P | D | R | O | S | M | K | X | L | |
| J | T | V | G | W | Y | O | S | K | X | D | A | R | C | M | E | F | B | Z | L | P | I | N | H | U | |

64k 64j

FIG. 12

LETTER PLACEMENT GAME

RELATED APPLICATION

This application is a continuation of U.S. patent application Ser. No. 13/407,966, filed Feb. 29, 2012, the entire teachings of which are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

Historically, printed games have existed based on words, numbers, and/or characters. One format provides a typically rectangular grid marked off by intersecting horizontal and vertical lines to produce cells or boxes. In one conventional approach, a starting (unsolved) puzzle includes characters in all of the cells, and a player of the game examines the array of characters to solve the game. In another conventional approach, the starting puzzle includes cells that are blank, and a player examines the puzzle to determine how to fill in the blank cells.

One well known approach is that taken by Sudoku games. In a typical Sudoku game, a grid is a nine by nine square, and the characters for the game are the digits one through nine (1-9). Each horizontal row in the grid contains nine digits, and each vertical row in the grid contains nine digits (in the solved puzzle). The square grid is further divided into nine subgrids, and each subgrid is a three by three square that contains nine digits (in the solved puzzle). A starting puzzle is provided that has digits presented in some cells, and some cells are blank. The game is played by adding a digit for each blank cell. When the puzzle is completed and solved, each digit must be unique in three ways. For a particular cell with a digit, the digit must be unique for its horizontal row; that is, there cannot be a duplicate of the digit in its horizontal row. The particular digit must also be unique for its vertical row. Furthermore, the particular digit must be unique for its subgrid. Provisional patent application U.S. 61/200,740, titled "Letter Placement Puzzle," and filed Dec. 4, 2008 by Jefferson W. Cleghorn, describes a puzzle based on a grid having twenty-five-by-twenty-five (25×25) cells for letters. The grid is divided into 25 subgrids, with each subgrid having dimensions of five-by-five (5×5) cells. Each letter entered into a cell in the solved puzzle must be unique for its horizontal row, its vertical row, and its subgrid.

SUMMARY OF THE INVENTION

In one aspect, the invention features a letter placement game, including a puzzle grid having cells, horizontal rows, vertical rows, and subgrids. Each subgrid, each horizontal row, and each vertical row have an equal number of cells. The letter placement game has a predetermined set of characters and clue input. The puzzle grid includes filled cells and empty cells. Each filled cell includes one of the characters. Each empty cell is associated with a predetermined solution character. The clue input includes a plurality of clues. Each clue has a solution to each clue based on the predetermined set of characters. Each clue is associated with a predetermined location in the puzzle grid, and each predetermined location is associated with a predetermined number of empty cells. Each clue solution has a set of solution characters corresponding to the predetermined number of empty cells associated with each clue. The letter placement game also includes character singularity rules requiring that each (i) horizontal row contains one set of the predetermined characters having one instance of each character, (ii) each vertical row contains one set of the predetermined characters having one instance of each character, and (iii) each subgrid contains one set of the predetermined characters having one instance of each character. The letter placement game further includes a puzzle solution for the puzzle grid. Each character in each set of solution characters conforms to the character singularity rules, and each solution character for each empty cell conforms to the character singularity rules.

In one embodiment, the predetermined set of characters is based on an alphabet, and the clues are words. In another embodiment, each clue includes a sequence of words. Each clue, in another embodiment, includes one or more words providing a hint for each clue solution. In a further embodiment, each clue includes one or more word fragments providing a hint for each clue solution. Each clue, in another embodiment, includes one or more words and one or more word fragments providing a hint for each clue solution.

In a further embodiment, one or more sets of solution characters include multiple instances of one character, requiring that each set of solution characters having the multiple instances of one character traverse one or more subgrid boundaries in order to satisfy the character singularity rules.

In another aspect, the invention features a method for conducting a letter placement game, including providing a puzzle grid, providing a predetermined set of characters, providing a set of character singularity rules, receiving clue input including clues for a puzzle grid and receiving a request to generate a puzzle grid based on the clues. The method further includes generating the puzzle grid based on the clue input, a puzzle solution for the puzzle grid, and providing the puzzle grid and the puzzle solution in response to the request to generate the puzzle grid. The puzzle grid has cells, horizontal rows, vertical rows, and subgrids. Each subgrid, each horizontal row, and each vertical row have an equal number of cells. The puzzle grid includes filled cells and empty cells. Each filled cell includes one of the characters. Each empty cell is associated with a predetermined solution character. The set of character singularity rules require that (i) each horizontal row contains one set of the predetermined characters having one instance of each character, (ii) each vertical row contains one set of the predetermined characters having one instance of each character, and (iii) each subgrid contains one set of the predetermined characters having one instance of each character. Each clue has a solution to each clue based on the predetermined set of characters. Each clue is associated with a predetermined location in the puzzle grid. Each predetermined location is associated with a predetermined number of empty cells. Each clue solution has a set of solution characters corresponding to the predetermined number of empty cells associated with each clue. Each character in each set of solution characters conforms to the character singularity rules, and each solution character for each empty cell conforms to the character singularity rules.

In another aspect, the invention features a server for conducting a letter placement game, the server communicating with a network. The server includes a memory for storing an instruction set, and a processor for running the instruction set. The processor is in communication with the memory and the network. The instruction set programs the processor to provide a puzzle grid, to provide a predetermined set of characters, to provide a set of character singularity rules, to receive clue input including clues for a puzzle grid, to receive a request to generate a puzzle grid based on the clues, to generate the puzzle grid based on the clue input, to generate a puzzle solution for the puzzle grid, and to provide the puzzle grid and the puzzle solution in response to the request to generate the puzzle grid. The puzzle grid has cells, horizontal rows, vertical rows, and subgrids. Each subgrid, each horizontal row, and each vertical row have an equal number of cells. The puzzle grid includes filled cells and empty cells. Each filled cell includes one of the characters. Each empty cell is associated with a predetermined solution character. The set of character singularity rules require that (i) each horizontal row contains one set of the predetermined characters having one instance of each character, (ii) each vertical row contains one set of the predetermined characters having one instance of each character, and (iii) each subgrid contains one set of the predetermined characters having one instance of each character. Each clue has a solution to each clue based on the predetermined set of characters. Each clue is associated with a predetermined location in the puzzle grid. Each predetermined location is associated with a predetermined number of empty cells. Each clue solution has a set of solution characters corresponding to the predetermined number of empty cells associated with each clue. Each character in each set of solution characters conforms to the character singularity rules, and each solution character for each empty cell conforms to the character singularity rules.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention. The following notice is for FIGS. 3 through 12: © 2012 Jefferson W. Cleghorn.

FIG. 1 is an illustration of a letter only puzzle with some empty cells.

FIG. 2 is an illustration of a letter only puzzle providing the solution for the puzzle depicted in FIG. 1.

FIG. 5 is an illustration of a word search puzzle solution that is associated with FIGS. 3 and 4, in accordance with principles of the invention.

FIG. 10 is an illustration of a clue list display for a starting numbered clue puzzle grid, in accordance with principles of the invention.

FIG. 11 is an illustration of a starting numbered clue puzzle grid with some empty cells that is associated with the text display of FIG. 10, in accordance with principles of the invention.

FIG. 12 is an illustration of a numbered clue puzzle solution that is associated with FIGS. 10 and 11, in accordance with principles of the invention.

DETAILED DESCRIPTION

Figure 3:
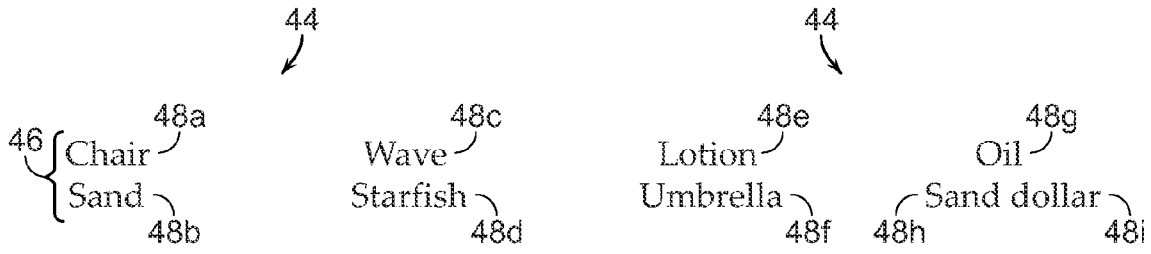
FIG. 3 is an illustration of a text clue display for a word search puzzle, in accordance with principles of the invention.

In brief overview, the present invention relates to a letter placement game. In one embodiment, the letter placement game is based on a grid having twenty-five-by-twenty-five (25×25) cells. The grid is divided into 25 subgrids, with each subgrid having dimensions of five-by-five (5×5) cells.

The choice of characters in the letter solution puzzle must follow a set of rules, referred to herein as "character singularity rules." These rules mean that each horizontal row of the grid contains one instance of each character in a predetermined set of characters, which is, in one embodiment, the alphabet with one letter omitted so that there are twenty-five characters in the set of characters. In one embodiment, the letter "Q" is omitted. Each vertical row of the grid contains one instance of each character in the predetermined set of characters. Each subgrid contains one instance of each character in the predetermined set of characters. The letter placement game also includes sequences of characters, for example, words, which also must follow the character singularity rules for each character in a word, as described herein in various embodiments of the invention depicted and described for FIGS. 3-12.

Typically in a letter puzzle (that is, a beginning or starting puzzle), some cells are filled with characters, and some cells are empty. The goal of the letter placement game, in various embodiments of the invention, is to determine what characters are required to fill in the empty cells, which are subject to dual sets of requirements because some characters are required to satisfy character singularity rules and simultaneously other requirements, such as being part of a set of solution characters (for example, a word). Thus, various embodiments of the letter placement game have the advantage of being more interesting and challenging to solve because dual sets of requirements must be met.

FIG. 1 is an illustration of a starting letter puzzle 20 depicting a grid 22 of cells, having filled cells 24 and empty cells 28. The starting letter puzzle 20 is a letter only puzzle that is not intended to display words, in contrast to puzzle embodiments according to principles of the invention (see FIGS. 3-12) that also include sets of solution characters, for example, words. In some embodiments, some words may appear in the starting letter puzzle 20 by happenstance, typically being three or four letter words, but such words are not intended, as in the intended words that are planned to be part of a puzzle, as in FIGS. 3-12. The patterns of characters 26 in the starting letter puzzle 20 are intended to be random, or may be pseudorandom, depending on the method used to produce the starting letter puzzle 20. The starting letter puzzle 20, as depicted in FIG. 1, includes twenty-five 5×5 subgrids 30, eight subgrid boundaries (generally referred to by reference number 32), twenty-five horizontal rows 34, and twenty-five vertical rows 36.

FIG. 2 is an illustration of a letter puzzle solution 40. The puzzle solution 40 provides the solution to the starting letter puzzle 20 of FIG. 1. The puzzle solution 40 depicts solution characters 42 that fill the empty cells 28 of the starting letter puzzle 20. For example, in the eleventh cell of the first horizontal row 34 in the starting letter puzzle 20 of FIG. 1 is an empty cell 28. The eleventh cell of the first horizontal row 34 in the puzzle solution 40 of FIG. 2 is a filled cell 24 containing the solution character 42, which is the letter "Y."

FIG. 3 is an illustration of a text clue display 44 for a starting search puzzle grid 50 (see FIG. 4) in accordance with principles of the invention. The clue display 44 illustrates a word search clue set 46, and clue words 48*a*, 48*b*, 48*c*, 48*d*, 48*e*, 48*f*, 48*g*, 48*h*, and 48*i* (referred to generally as clue word 48). Typically, the clue display 44 is depicted on the same page or same presentation as the associated word search puzzle grid 50, and immediately above the word search puzzle grid 50.

Figure 4:
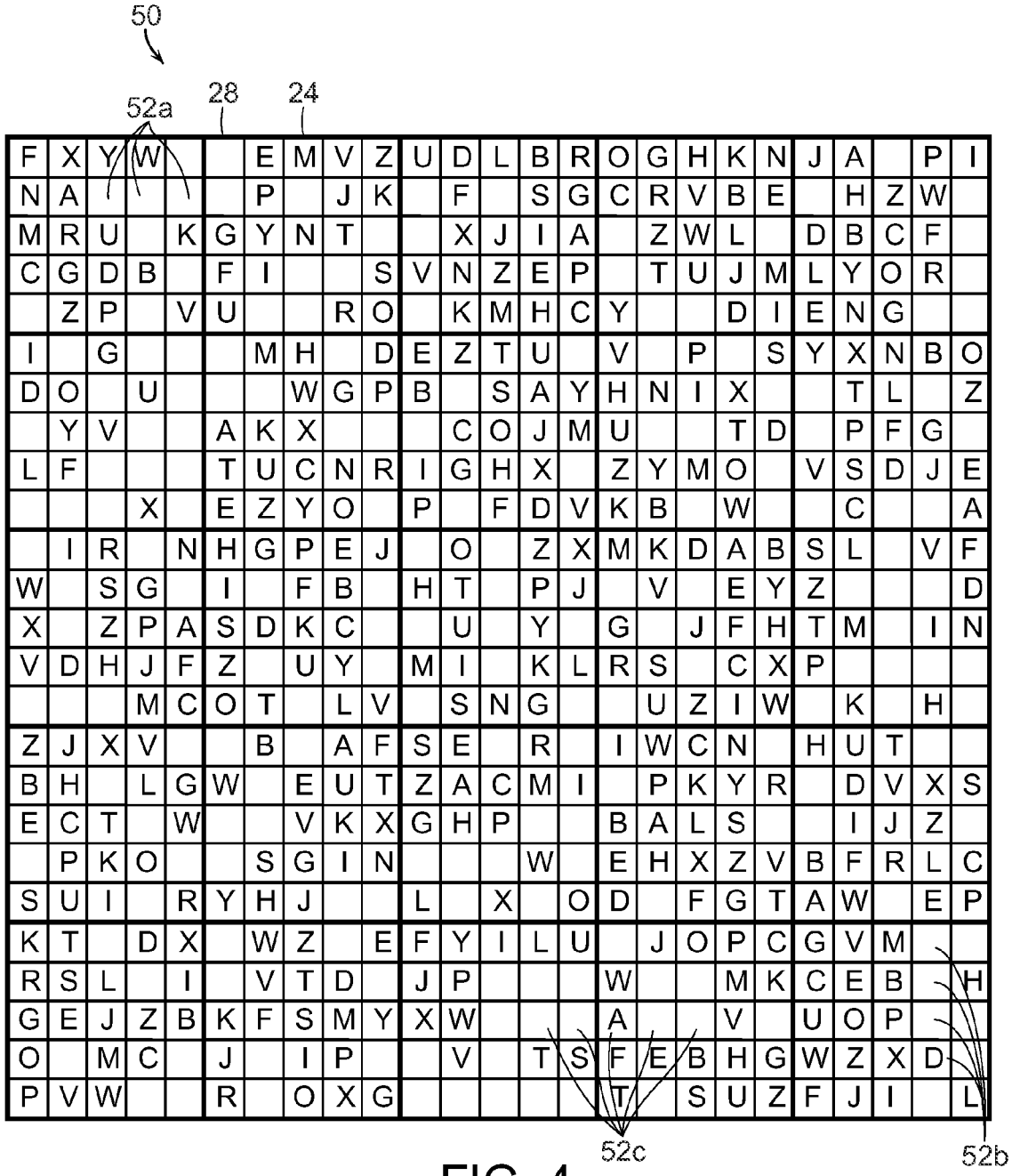
FIG. 4 is an illustration of a starting word search puzzle with some empty cells that is associated with the text clue display of FIG. 3, in accordance with principles of the invention.

FIG. 4 is an illustration of the starting word search puzzle grid 50 with filled cells 24 and empty cells 28, in accordance with principles of the invention. The starting word search puzzle grid 50 is associated with the clue display 44 of FIG. 3. Each clue word 48 is associated with a location (referred to generally as clue locations 52, such as representative clue locations 52*a*, 52*b*, and 52*c* in FIG. 4). Each clue location 52 indicates a number of cells (typically empty cells 28) that correspond to the length of the clue word 48 associated with that clue location 52.

Figure 14:
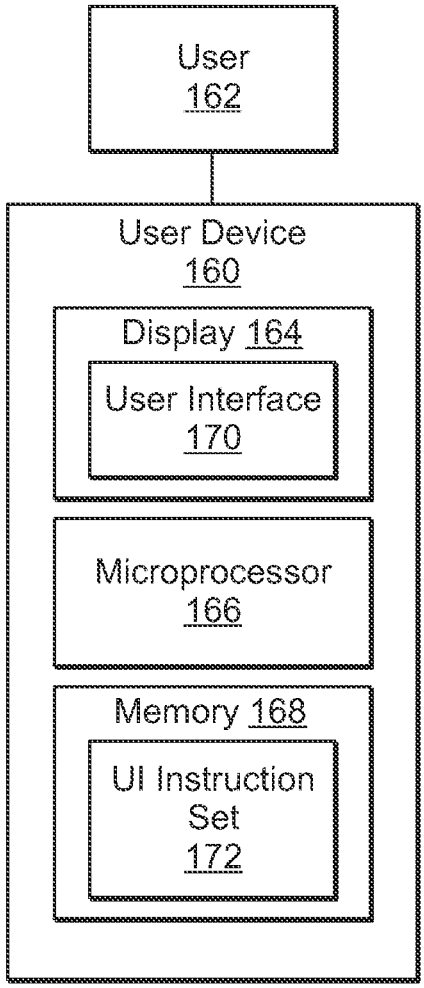
FIG. 14 is a schematic diagram of a user device for playing a letter placement game, in accordance with principles of the invention.
Figure 15:
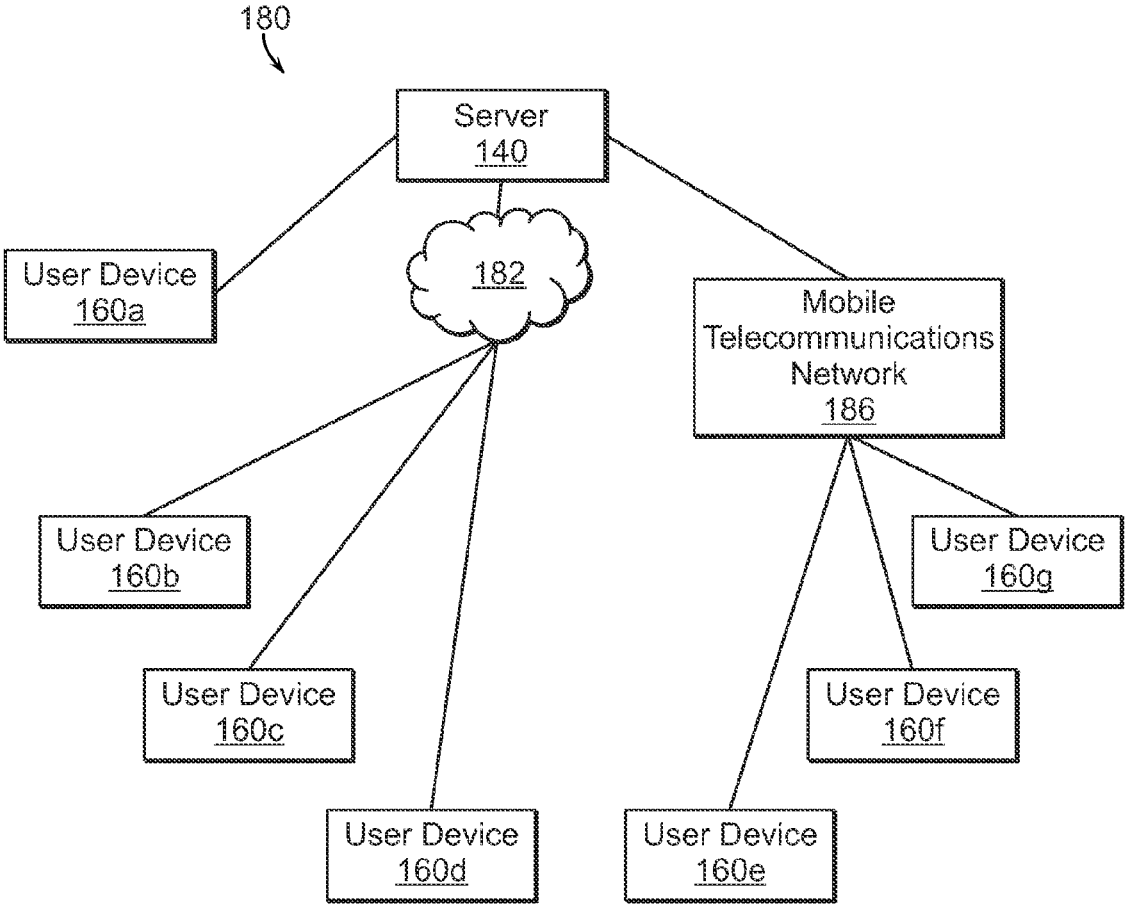
FIG. 15 is a block diagram of server and user device connections over a network, in accordance with principles of the invention.

FIG. 5 is an illustration of a word search puzzle solution 60 that is associated with FIGS. 3 and 4, in accordance with principles of the invention. FIG. 5 depicts the word search puzzle solution 60 for the starting word search puzzle grid 50 depicted in FIG. 4. Each clue word 48 is associated with a solution (referred to generally as clue solutions 62, such as representative clue solutions 62*a*, 62*b*, and 62*c* in FIG. 5). For example, clue word 48*g* ("OIL") is associated with clue location 52*a* (see FIG. 4) and clue solution 62*a* (see FIG. 5). Clue word 48*b* ("SAND") is associated with clue location 52*b* (see FIG. 4) and clue solution 62*b* (see FIG. 5). Clue word 48*a* ("CHAIR") is associated with clue location 52*c* (see FIG. 4) and clue solution 62*c* (see FIG. 5). As shown in the sample clue location 52*c*, the clue location 52 is not required to be all empty cells 28, but can also include one or more filled cells 24 (as shown by the letter "A" in clue location 52*c* in FIG. 4), which is also part of the clue solution 62*c*. In one embodiment, a player of the letter placement game provides characters 26 that are prospective solutions (such as prospective solution characters 42) by writing them in on a hard copy or printed copy of a puzzle grid; for example, starting word search puzzle grid 50 (see FIG. 4), starting word sequence puzzle grid 80 (see FIG. 7), or starting numbered clue puzzle grid 120 (see FIG. 11). The hard copy or printed copy, in various embodiments, is a puzzle book or other book, a puzzle in a newspaper or other hard-copy publication, a sheet of paper with a puzzle on it (such as a printout from a computer, such as user device 160, which is depicted in FIGS. 14 and 15), or puzzle made available in some other hard-copy format that can be written on or marked by a writing or marking device in some suitable manner. In other embodiments, a player of the letter placement game provides a character 26 that is a prospective solution (such as a prospective solution character 42) by entering the character 26 into an empty cell 28 in a starting puzzle grid displayed on a user interface 170 presented on a display 164 of a user device 160 (see FIG. 14); for example, by typing or selecting a character 26 from a keyboard for a selected empty cell 28, by using a mouse to select a character 26 from a display of characters and dragging and dropping the character 26 to a selected empty cell 28, by writing a character 26 with a stylus into an selected empty cell 28 for a display 164 accepting written input, or other suitable approach for entering data onto a user interface 170 provided on a display 164.

Furthermore, FIG. 5 illustrates traversing words (referred to generally as traversing solutions 64, such as representative traversing solutions 64*a*, 64*b*, 64*c*, and 64*d*). Each traversing solution 64 crosses one or more boundaries (referred to generally as subgrid boundaries 32, such as subgrid boundaries 32*a*, 32*b*, 32*c*, 32*d*, 32*e*, 32*f*, 32*g*, and 32*h* in FIG. 5). Thus traversing solution 64*a* (for the word "STARFISH") traverses subgrid boundaries 32*e* and 32*d*. Traversing solution 64*b* (for the word "LOTION") traverses subgrid boundaries 32*g* and 32*d*. Traversing solution 64*c* (for the combination word "SANDDOLLAR") traverses subgrid boundaries 32*h*, 32*a*, 32*g*, and 32*b*. Traversing solution 64*d* (for the word "UMBRELLA") traverses subgrid boundaries 32*f*, 32*a*, and 32*e*.

The traversing solution 64 provides a further level of clues and strategies for solving a puzzle grid (for example, 50 in FIG. 4). If a clue word 48 has two of the same letter adjacent to each other (as in two letter "L"'s in clue word 48*f* "UMBRELLA"), then the word must cross a subgrid boundary 32 to accommodate the two duplicate letters. Thus, the clue word 48*f* "UMBRELLA" crosses subgrid boundary 32*e* as traversing solution 64*d*, so that the character singularity rules are not violated; in other words, to insure that each letter "L" is in a different subgrid 30. Thus, the player of the game deduces that the word "UMBRELLA" must be in such a location that two letters "L" are located on different sides of a subgrid boundary 32 in the solution. A similar approach applies to the combined clue 46 for "SANDDOLLAR," which has two clue words 48*h* and 48*i* (see FIG. 3) and is shown in FIG. 5 as a continuous sequence of letters as traversing solution 64*c*. A player of the game recognizes that "SANDDOLLAR" must cross a subgrid boundary 32 for the duplicate letters "D" and again for the duplicate letters "L." Thus, the traversing solution 64*c* ("SANDDOLLAR") crosses subgrid boundary 32*a* to locate the two letters "D" in different subgrids 30, and crosses subgrid boundary 32*g* to locate the two letters "L" in different subgrids 30.

In another approach, the player of the game forms a strategy, based on two (or more) duplicate letters that are not adjacent in a clue 46. For example, the clue word 48*e* ("LOTION") has two letters "O", and thus indicates that "LOTION" must traverse at least one subgrid boundary 32.

Thus, the player of the game formulates a strategy to examine the puzzle grid 50 to determine possible clue locations 52 for "LOTION" that cross at least one subgrid boundary 32. This strategy is confirmed by the traversing solution 64*b* for "LOTION" in FIG. 5, which traverses the subgrid boundary 32*g* in order to locate the duplicate letters "O" in two subgrids 30.

Thus, the letter placement game provides at least two levels of analysis, in that a solution character 42 chosen to fill an empty cell 28 to produce a filled cell 24 must satisfy character singularity rules, as described elsewhere herein. Also, if the resulting filled cell 24 is part of a set of solution characters 62 for a predetermined location 52 in the grid 22, the filled cell 24 is also associated with the set of solution characters 62, which may be a sense unit or semantic unit, such as a word, or may be part of a sequence of words. In various embodiments, a set of solution characters 62 forms some logical or meaningful unit, such as an abbreviation, an acronym, part of the alphabet, or other appropriate unit.

Figure 7:
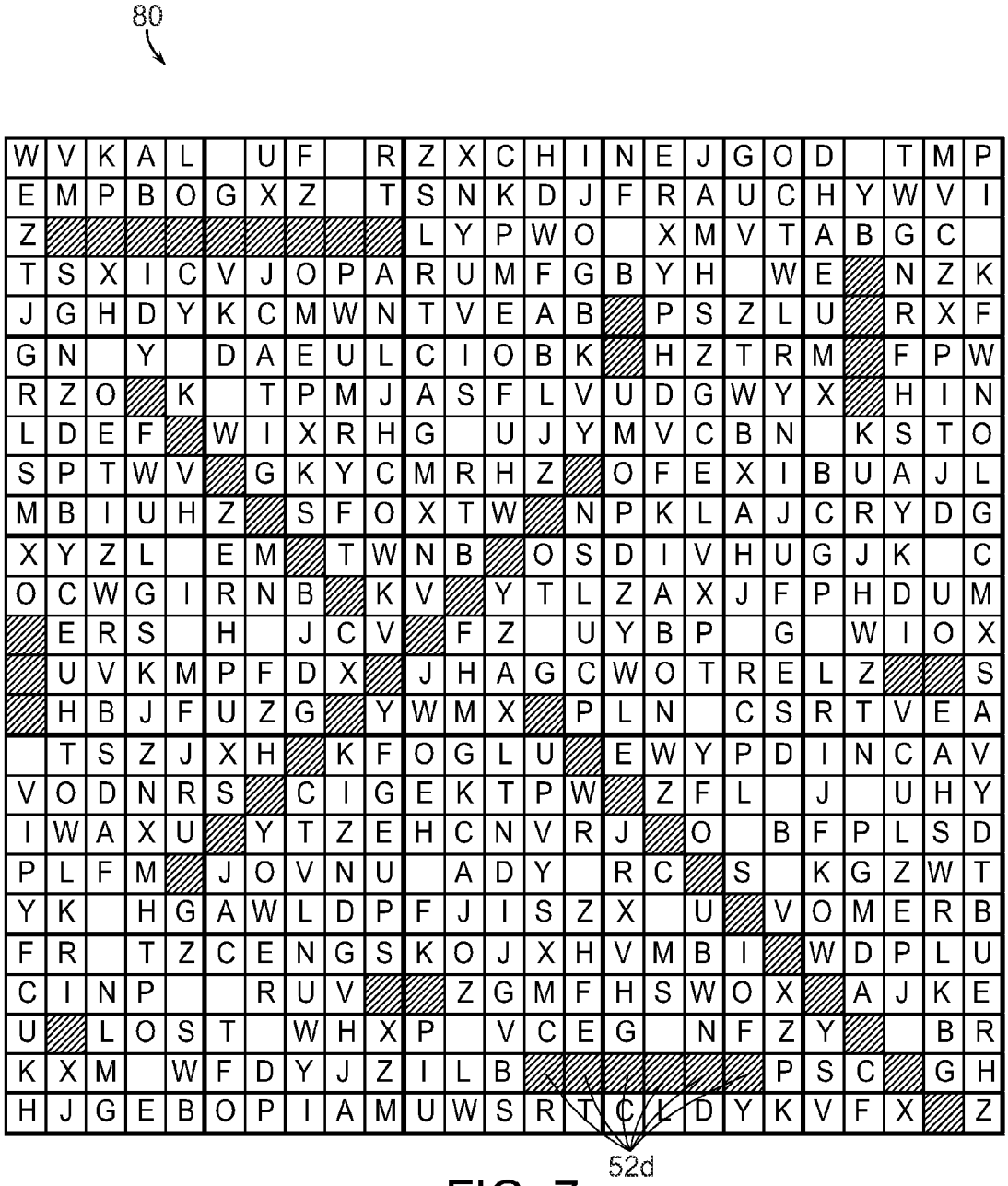
FIG. 7 is an illustration of a starting word sequence puzzle grid with some empty cells that is associated with the word sequence display of FIG. 6, in accordance with principles of the invention.

Thus the letter placement game provides the advantage of providing multiple ways of solving a puzzle (for example word search puzzle grid 50 as in FIG. 4, word sequence puzzle grid 80, as in FIG. 7, or numbered clue puzzle grid 120 as in FIG. 11). One approach to solve the puzzle is based on the character singularity rules, as descried elsewhere herein. Another approach is to solve the set of solution characters 62, based on the sense or semantic meaning of the set of solution characters 62 (for example, word). A further approach is to analyze information about duplicate letters in a set of solution characters 62 that indicate a traversing solution 64 in a puzzle solution (for example, puzzle solution 60 in FIG. 5) that must cross one or more subgrid boundaries 32. A further way is to alternate between the approaches. Thus, the letter placement game provides the advantage of having one game that can be played in multiple ways, and mixing both a character singularity approach (not semantically oriented) with a different approach that engages semantic thinking (for example, determining words, and word sequences) and other approaches, such as looking for duplicate letters that indicate a traversing solution 64. Different players are able to approach the letter placement game in different ways depending on each player's inclinations. Thus, the same letter placement game offers the unexpected advantage of being pursued, in effect, as different types of games without any alternation to the starting puzzle for a letter placement game.

Figure 6:
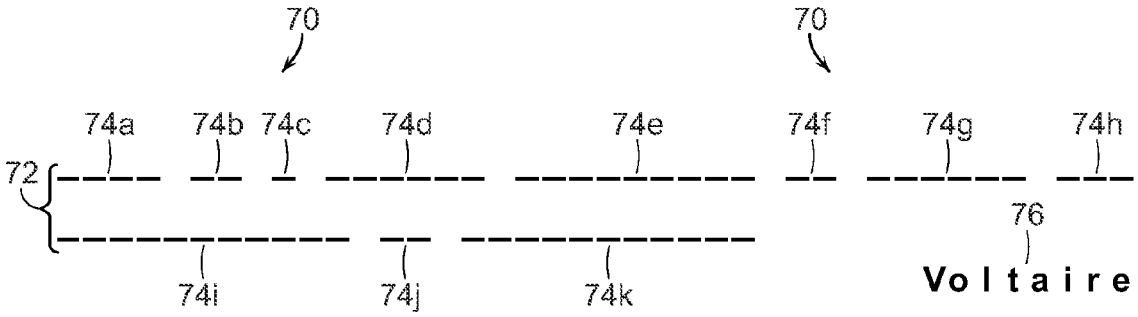
FIG. 6 is an illustration of a word sequence text display for a starting word sequence puzzle, in accordance with principles of the invention.

FIG. 6 is an illustration of a word sequence starting display 70 for a word starting sequence puzzle grid 80 (see FIG. 7) in accordance with principles of the invention. The word sequence starting display 70 provides word sequence clue set 72, including words (referred to generally as word sequence clues 74, such as word sequence clues 74*a*, 74*b*, 74*c*, 74*d*, 74*e*, 74*f*, 74*g*, 74*h*, 74*i*, 74*j*, and 74*k*). FIG. 6 also shows the author 76 of the word sequence. In another embodiment, the author 76 is not displayed. In various embodiments, the word sequence starting display 70 is based on various types of word sequences, such as sentences, phrases, or sentence fragments from various sources, including quotes from various authors or other originators.

FIG. 7 is an illustration of a starting word sequence puzzle grid 80 with some empty cells 28 that is associated with the word sequence starting display 70 of FIG. 6, in accordance with principles of the invention. The word sequence puzzle grid 80 includes clue locations 52, for example, clue location 52*d*, which has six empty cells 28, and thus accommodates a word (or character sequence) that is six characters 26 in length.

Figure 8:
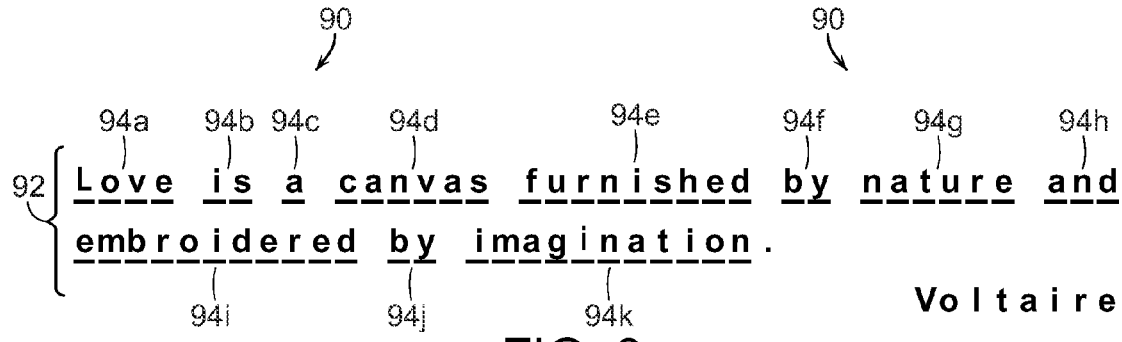
FIG. 8 is an illustration of a word sequence text display for a word sequence puzzle solution that is associated with FIGS. 6, 7 and 9, in accordance with principles of the invention.
Figure 9:
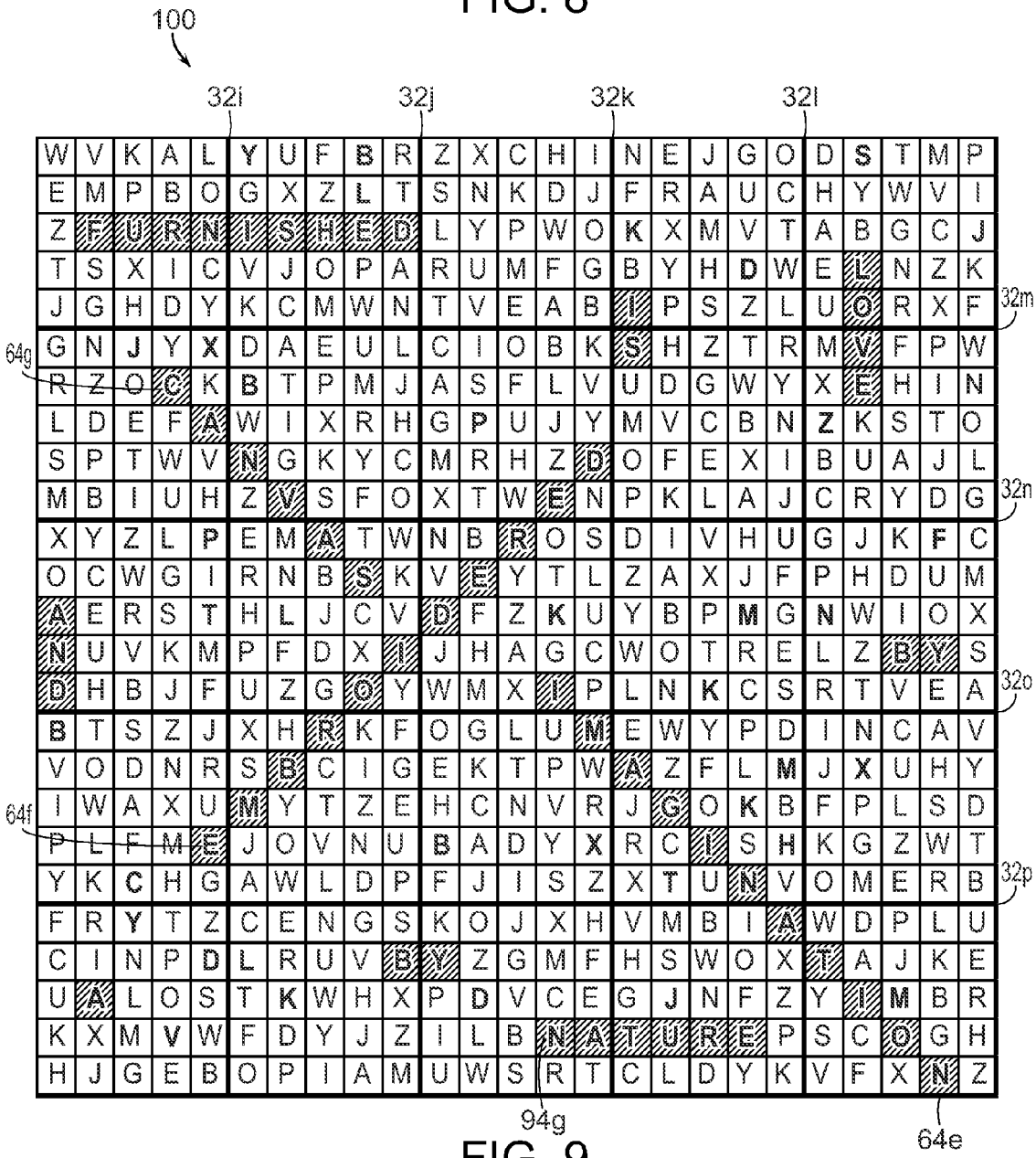
FIG. 9 is an illustration of a word sequence puzzle solution that is associated with FIGS. 6, 7, and 8, in accordance with principles of the invention.

FIG. 8 is an illustration of a word sequence solution display 90 for the word sequence puzzle solution 100 (as depicted in FIG. 9) in accordance with principles of the invention. FIG. 8 includes a word sequence solution set 92 including word sequence clue solutions 94 referring generally to 94*a*, 94*b*, 94*c*, 94*d*, 94*e*, 94*f*, 94*g*, 94*h*, 94*i*, 94*j*, and 94*k*). Each word sequence clue solution 94 is the solution for a word sequence clue 74 (see FIG. 6). For example clue solution 94*a* is the solution for word sequence clue 74*a*; clue solution 94*b* is the solution for word sequence clue 74*b*; and so on. A word sequence clue 74 is not required to be blank (that is, not showing any letters). In other embodiments, each word sequence clue 74 provides one or more letters as a hint to the solution of that clue 74. In one example of a letter as a hint, the word sequence clue 74*a* can be modified to show the letter "e" in the last position (not shown in FIG. 6), thus partially revealing the clue solutions 94*a* (which is "Love"). In another example of letters as a hint, the word sequence clue 74*d* can be modified to show the letters "c" and "a" in the first two positions (not shown in FIG. 6), thus partially revealing the clue solutions 94*d* (which is "canvas"). In various embodiments, some or all of the word sequence clues 74 have one or more letters revealed without revealing the entire word.

FIG. 9 is an illustration of a word sequence puzzle solution 100 that is associated with FIGS. 6, 7 and 8, in accordance with principles of the invention. The word sequence puzzle solution 100 is the solution for the word sequence puzzle grid 80 of FIG. 7. For example the clue solution 94*g* (which is "NATURE") is depicted in FIG. 9 and is located at the clue location 52*d* shown as empty cells 28 in FIG. 7.

Furthermore, FIG. 9 illustrates solutions (referred to generally as traversing solutions 64, such as representative traversing solutions 64*e*, 64*f*, and 64*g* in FIG. 9). Each traversing solution 64 crosses one or more subgrid boundaries 32, such as subgrid boundaries 32*i*, 32*j*, 32*k*, 321, 32*m*, 32*n*, 32*o*, and 32*p* in FIG. 9). Thus traversing solution 64*e* (for the word "IMAGINATION") traverses subgrid boundaries 32*o*, 32*k*, 32*p*, and 32*l*. Traversing solution 64*f* (for the word "EMBROIDERED") traverses subgrid boundaries 32*i*, 32*o*, 32*j*, and 32*n*. Traversing solution 64*g* (for the word "CANVAS") traverses subgrid boundaries 32*i* and 32*n*.

As described elsewhere herein, the word sequence clues 74 are evaluated for duplicate letters and clue solutions 94 that cross one or more subgrid boundaries 32. Thus, if a clue location 52 crosses one or more subgrid boundaries 32, then the corresponding clue solution 94 may have two (or more) duplicate letters, which aids in determining what the solution is to a particular word sequence clue 74. Thus, a strategy based on traversing solutions 64 is pursued.

FIG. 10 is an illustration of a clue list display 110 for a numbered clue puzzle grid 120 (see FIG. 11) in accordance with principles of the invention. FIG. 10 displays numbered clues 112. In the clue list display 110, the numbered clues 112 are shown in two columns. In each column, the clue number is provided on the left, and the associated words or hints are provided on the right. Thus for clue number one in the clue list display 110, the clue is "Telepathic TV character (4)", for clue number two the associated clue is "spin(5)", and so on. For each clue 112, the number in parentheses indicates the number of empty cells 28 in the clue location 52 for that clue 112. Thus, for example, for clue number one, the number in parentheses is "4" and indicates the number of empty cells 28 at clue location 52*e* (see FIG. 11).

FIG. 11 is an illustration of a starting numbered clue puzzle grid 120 with empty cells 28 that is associated with the clue list display 110 of FIG. 10 in accordance with principles of the invention. The clue number in the clue list display 110 is the same as the "Gray Box #" which indicates that the clue number appears in the first gray box at the clue location 52 for that clue (referred to generally as numbered cell 122, such as representative numbered cells 122*a*, 122*b*, and 122*c* in FIG. 11). Thus, for example, clue number one has a "1" displayed in numbered cell 122*a* at clue location 52*e* in FIG. 11. The clue number is displayed in the numbered cell 122 in various ways in various embodiments. In one embodiment, the numbered cell 122 contains the clue number as a white or light colored letter on a gray background. In various embodiments, the numbered cell 122 and clue number are presented with various backgrounds and clue number colors, font styles, or other suitable approaches. In another embodiment, the numbered cell 122 contains the clue number in an elevated (or superscript) position or other suitable position within the numbered cell 122.

FIG. 12 is an illustration of a numbered clues puzzle solution 130 that is associated with FIGS. 10 and 11, in accordance with principles of the invention. FIG. 12 also displays solutions (referred to generally as clue solutions 132, such as clue solutions 132*a* and 132*b*). Clue solution 132*a* depicts the solution for clue number one, and clue solution 132*b* depicts the solution for clue number two.

Furthermore, FIG. 12 illustrates traversing solutions 64 (for FIG. 11 referring generally to representative traversing solutions 64*h*, 64*i*, 64*j*, and 64*k*). Each traversing solution 64 crosses one or more subgrid boundaries 32, such as subgrid boundaries 32*q*, 32*r*, 32*s*, 32*t*, 32*u*, 32*v*, 32*w*, and 32*x* in FIG. 12. Thus traversing solution 64*h* (for the word "KOWTOW") traverses subgrid boundaries 32*r* and 32*u*. Traversing solution 64*i* (for the word "TEMPERATE") traverses subgrid boundaries 32*q*, 32*v*, 32*r*, and 32*u*. Traversing solution 64*j* (for the word "PADDLE") traverses subgrid boundaries 32*x* and 32*s*. Traversing solution 64*k* (for the word "JABBERING") traverses subgrid boundaries 32*q*, 32*x*, 32*r*.

Figure 13:
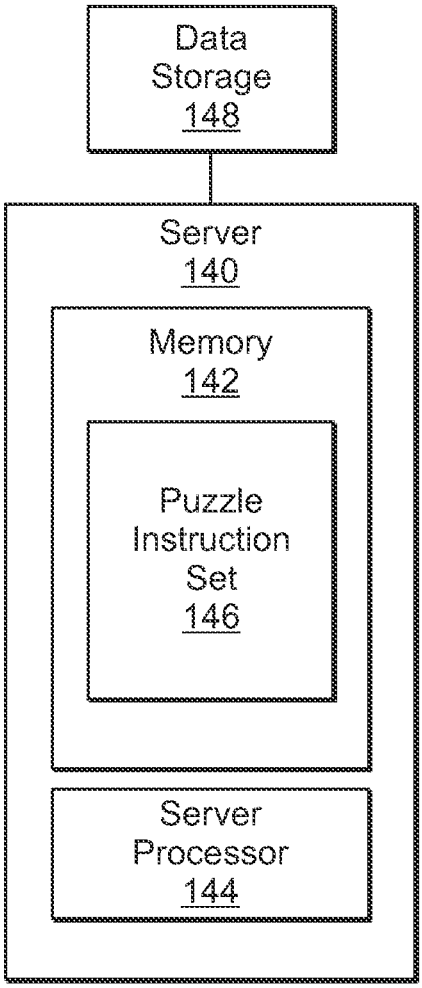
FIG. 13 is a schematic diagram of a server for conducting a letter placement game and providing related services, in accordance with principles of the invention.

FIG. 13 is a schematic diagram of a server 140 for conducting a game and providing related services, in accordance with principles of the invention. The server 140 includes a memory 142 and server processor 144, and is connected to a data storage 148. The memory 142 is a volatile and/or nonvolatile memory that stores a puzzle instruction (PI) set 146. The server processor 144 is a digital microprocessor. The PI instruction set 146 programs the server processor 144 to perform the functions of a puzzle generator for the letter placement game and other functions related to the letter placement game, as described herein. The data storage 148 stores data for the server 140, which includes, in various embodiments, requests and communications from game players, starting puzzle grids (for example, puzzle grids 50, 80, and 120), puzzle solutions (for example, puzzle solutions 60, 100, and 130), and/or other suitable data associated with the server 140 and letter placement puzzle generation.

FIG. 14 is a schematic diagram of a user device 160 for playing a letter placement game and providing other placement game services, in accordance with principles of the invention. The user device 160 is a device used by a player or user 162 of the letter placement game to play the letter placement game and/or request that a new game be generated. The user 162, in one embodiment, is a designer of one or more puzzles for a letter placement game (for example, puzzle grids 50, 80, and/or 120, and corresponding puzzle solutions 60, 100, and/or 130). The user device 160 includes a display 164, a microprocessor 166, and memory 168. The display 164 provides, in one embodiment, for the presentation in one or more user interfaces of a puzzle grid for a user or player 162 of the game, who wishes to solve the puzzle grid, along with corresponding puzzle solutions. The user or player 162 enters characters 26 into empty cells 28 in a user interface 170 displaying a puzzle grid (for example, 50, 80, or 120) as proposed solution characters 42 for those cells 28. Such a user or player 162, in one embodiment, receives feedback and/or hints, including whether his proposed character 26 is a solution character 42 for a given cell. In a further embodiment, the user or player 162 selects interactive feedback, that provides varying levels of hints and/or other feedback depending on the level selected. In another embodiment, the display 164 provides for the presentation of one or more user interfaces 170, for a designer 162 of a puzzle, as depicted in FIGS. 17 through 21. The display 164, in one embodiment, is a flat electronic display. The display 164 in one embodiment is a separate free standing display electronically connected to the user device 160, such as a desktop computer. In other embodiments, the display 164 is incorporated into the body of the user device 160, such as for a mobile telephone, a mobile telecommunications pad device, a laptop computer device, a tablet computer device, a portable electronic reading device (for example, for reading books), or other portable digital processing device. In various embodiments, the user device 160 has mobile telecommunications capabilities, and/or other wireless communications. The memory 168 is a volatile and/or nonvolatile memory that stores a user interface (UI) instruction set 172. The device processor microprocessor 166 is a digital processor. The UI instruction set 172 programs the microprocessor 166 to provide the user interface 170 on the display 164 for playing the letter placement game, for requesting generation of a new letter placement game, for making other requests and communications to a server 140, and for performing other functions related to the letter placement game, as described herein. In various embodiments, functions of the server 140 and the user device 160 described herein are not meant to be limited to a particular device.

FIG. 15 is a block diagram of server 140 and multiple user devices 160 connections over a network 180 for conducting a letter placement game, in accordance with principles of the invention. The user or player 162 of the letter placement game accesses the game through a user device 160, such as user devices 160*a*, 160*b*, 160*c*, 160*d*, 160*e*, 160*f*, and 160*g* in FIG. 15. The communication connections in the network 180 shown in FIG. 15 to the user devices 160 are hard wired (metallic) connections, optic cable connections, wireless network connections, wireless mobile telecommunications connections, and/or other suitable connections. The communication connections in the network 180 can be based on any suitable protocol, such as packet based protocols (e.g., TCP/IP or Transmission Control Protocol/Internet Protocol), WAP (wireless application protocol), wireless protocols (for example, Bluetooth®, or Wi-Fi® (IEEE 802.11)), mobile telephone protocols (for example, CDMA or Code Division Multiple Access, G3, or G4), or other suitable protocols, including protocols to be developed in the future. In various embodiments, different communications protocols are used in different parts of the network 180.

In one embodiment, the server 140 connects to a user device 160*a*, for example, when both devices have compatible communications modules or capabilities, for example, local wireless communications capabilities. In other embodiments, the server 140 connects to user devices (for example, 160*b*, 160*c*, and 160*d*) through a network cloud 182, for example, using Internet connections, Web connections, and/or TCP/IP connections. In other embodiments, the server 140 connects to user devices (for example, 160*e*, 160*f*, and 160*g*) through a mobile telecommunications network 186. Players 162 who use different user devices 160 may engage in a group game or game-related activity. Such players 162 are not required to be on the same network or use the same connections. In various embodiments, players 162 compete to see who solves a newly released or available puzzle most quickly; for example, two such players 162 connect through user devices 160 using different networks, such as 160*c* and 160*g*. FIG. 15 is not meant to be limiting of the number of users 162 who are connected to the server 140, or limiting of the types and configurations of network connections. In one embodiment, a server 140 has all of its connections through a cloud network 182, and in another embodiment a server 140 has all of its connections through a mobile telecommunications network 186. In a further embodiment, the server 140 connects through a network cloud 182 to a local computer with a local area network (LAN) connecting to one or more user devices 160, for example, individual desktop computers serving as individual user devices 160 (not shown in FIG. 15).

Figure 16:
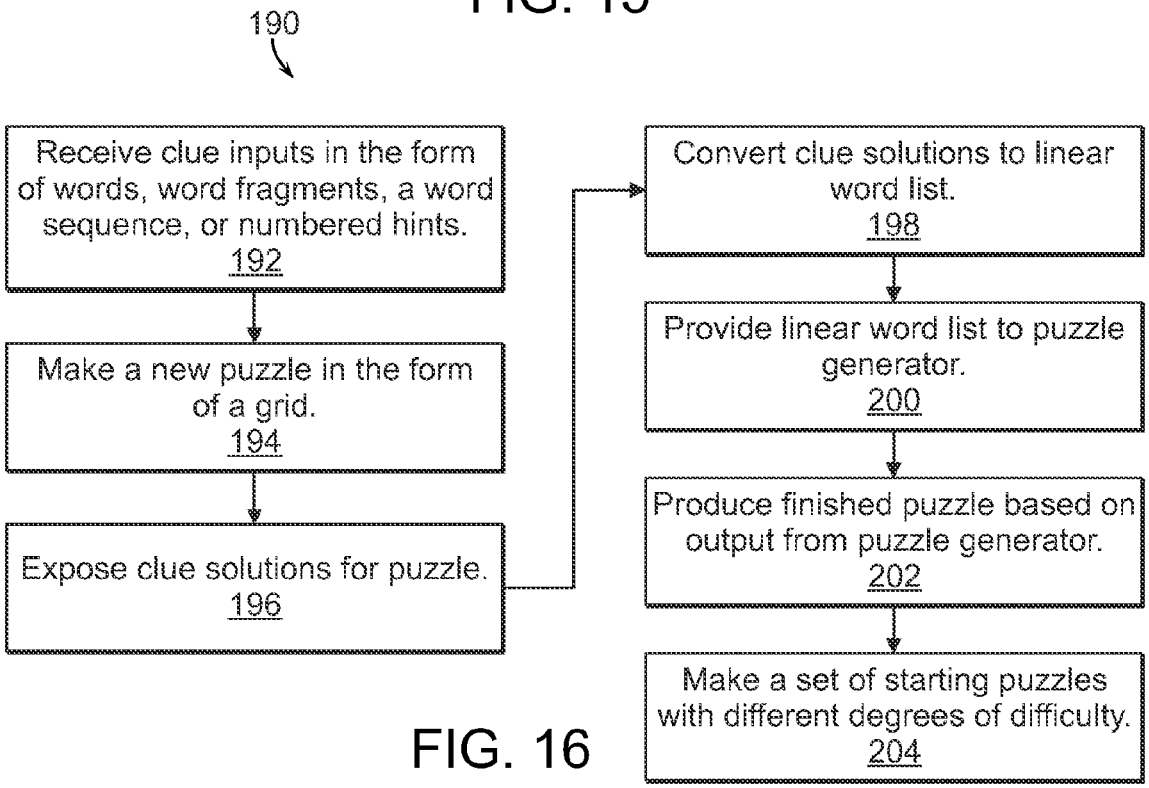
FIG. 16 is a flowchart for responding to a request for a new puzzle, in accordance with principles of the invention.

FIG. 16 is a flowchart 190 for responding to a game request in accordance with principles of the invention. In step 192, clue input (for example, word clues 46, word sequence clues 72, numbered clues 112, or other suitable clues) are received in the form of words, word fragments, or numbered hints. In one embodiment, the clue input includes complete words, such as the word clues 46 displayed in FIG. 3 for a starting word search puzzle grid 50 (see FIG. 4). In various embodiments, the word clues 46 are not required to be complete words, and the word clues 46 are word fragments (for example, word clues 46 with missing letters, or word clues 46 with only one or two letters provided per word clue 46).

Figure 17:
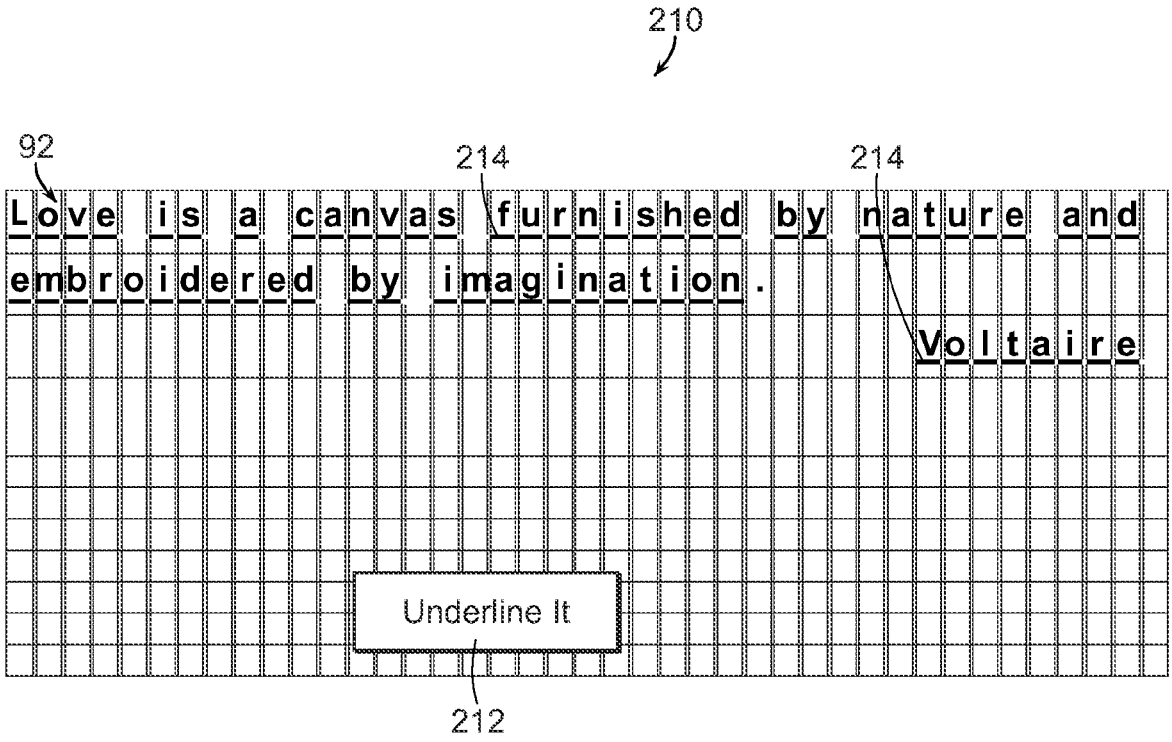
FIG. 17 is an illustration of a word sequence user interface, in accordance with principles of the invention.

In one embodiment that is an implementation of step 192, FIG. 17 is an illustration of a word sequence user interface (UI) 210 for a starting word sequence puzzle grid 80 (see FIG. 7) and puzzle solution 100 (see FIG. 9) in accordance with principles of the invention. The word sequence UI 210 includes clue input, depicted in FIG. 17 as words in a word sequence solution set 92 that provides a quote, and an Underline It Button 212 that provides underlining 214 for the word sequence solution set 92. In one embodiment, the word sequence UI 210 is termed a PHRASE user interface, which is intended for a player, user, or designer of a letter placement game to enter a phrase, other sentence fragment, or sentence into the word sequence UI 210 to provide clue input (clues and/or clue solutions) for a new puzzle. Alternatively, for entering word clue input for a starting word search puzzle grid 50, step 192 is performed, in one embodiment, by the new puzzle user interface UI 220 of FIG. 18, as described elsewhere herein.

Generally, FIGS. 17 through 21 provide user interfaces 170 (for example, user interfaces 210, 220, 230, and 240), in one embodiment, for a designer 162 of puzzles for the letter placement game. In one embodiment, the user interfaces 170 are implemented by the instructions 146 located on a server 140 for communication to a user device 160 for presentation at a display 164 at the user device 160. In another embodiment, the user interfaces 170 are implemented by the UI instructions 172 located on a user device 160 for presentation on the display 164. The user device 160 is in communication with the server 140 for functions such as puzzle generation, and other functions, such as retrieval of previously generated puzzle grids and puzzle solutions from the data storage 148 of the server 140, for example, starting puzzles (for example, puzzle grids 50, 80, and/or 120) and finished puzzles (for example, puzzle solutions 60, 100, and/or 130).

In one embodiment, as shown in FIG. 17, the clue input includes complete words, such as the words in a finished puzzle. For example, a word sequence solution set 92 is provided for a word sequence (for example, a quote), which is required in order to determine the word sequence puzzle grid 80 (see FIG. 7), and the word sequence puzzle solution 100 (see FIG. 9). The word sequence clue set 72 (see FIG. 6) in one embodiment are word sequence clues 74 (underlined blank spaces without the letters of the solution) that indicate how many letters there are in each word sequence clue solution 94 (see FIG. 8). In other embodiments, the word sequence clues 72 include one or more letters per word clue 74. In another embodiment, the clue input includes sentences, phrases, and/or sentence fragments as depicted in FIG. 10 for numbered clues 112 that provide hints about the word, phrase, and/or word fragment that are numbered clue solutions 132 (see FIGS. 11 and 12).

Figure 18:
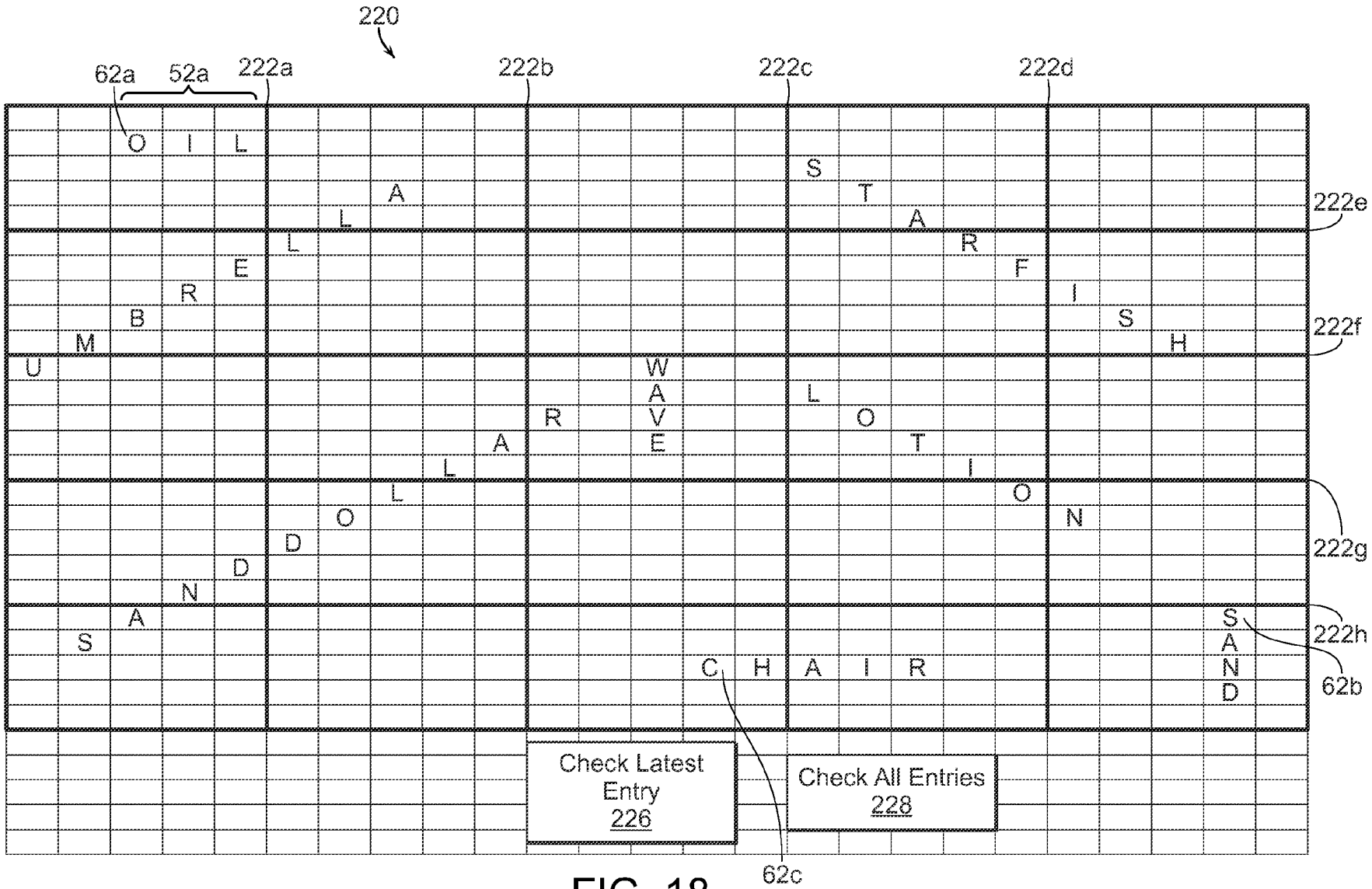
FIG. 18 is an illustration of a new puzzle user interface, in accordance with principles of the invention.

In step 194 (FIG. 16), a new puzzle is created in the form of a grid 22 based on the clue input with clue solutions 62 displayed and all other cells as empty cells 28. For one embodiment that is an implementation of step 194, FIG. 18 is an illustration of a new puzzle UI 220, in accordance with principles of the invention. The new puzzle UI 220 depicts clue solutions, such as clue solutions 62*a*, 62*b*, and 62*c* in FIG. 18. For example, clue solution 62*a* is shown at word clue location 52*a* in FIG. 18, which corresponds to the puzzles shown in FIG. 4 and FIG. 5. The new puzzle UI 220 depicts boundaries (referred to generally as UI subgrid boundaries 222, such as representative UI subgrid boundaries 222*a*, 222*b*, 222*c*, 222*d*, 222*e*, 222*f*, 222*g*, and 222*h* in FIG. 18).

In one embodiment, an advantage of the letter placement game described herein is that the clue input into a new puzzle UI 220 is not limited in position. For example, a word (for example, a clue solution 62) can be entered as clue input in a horizontal format, a vertical format, a diagonal format, a zigzag format, a circle, a curving format, or other suitable format in the new puzzle UI 220.

The new puzzle UI 220 also depicts a Check Latest Entry button 226 and Check All Entries button 228. The designer, player, or user 162, of a puzzle provides entries into the new puzzle UI 220 for word clues 46 that appear as clue solutions (for example, 62*a*) in the new puzzle UI 220. The new puzzle UI 220 corresponds to the puzzle solution 60 displayed in FIG. 5. After entering a clue solution (for example 62*a*), the Check Latest Entry button 226 is selected to determine that the last entered clue solution (for example 62*a*) meets the character singularity rules. After entering several clue solutions 62, the Check All Entries button 228 is selected to determine that all of the clue solutions (for example 62*a*) that have been entered meet the character singularity rules.

For a numbered clue puzzle (see FIGS. 10, 11, and 12), in one embodiment, clue numbers are provided after step 194 and before step 196 for each numbered cell 122 (FIG. 11) in accord with the numbered clues 112 (see FIG. 10).

Figure 19:
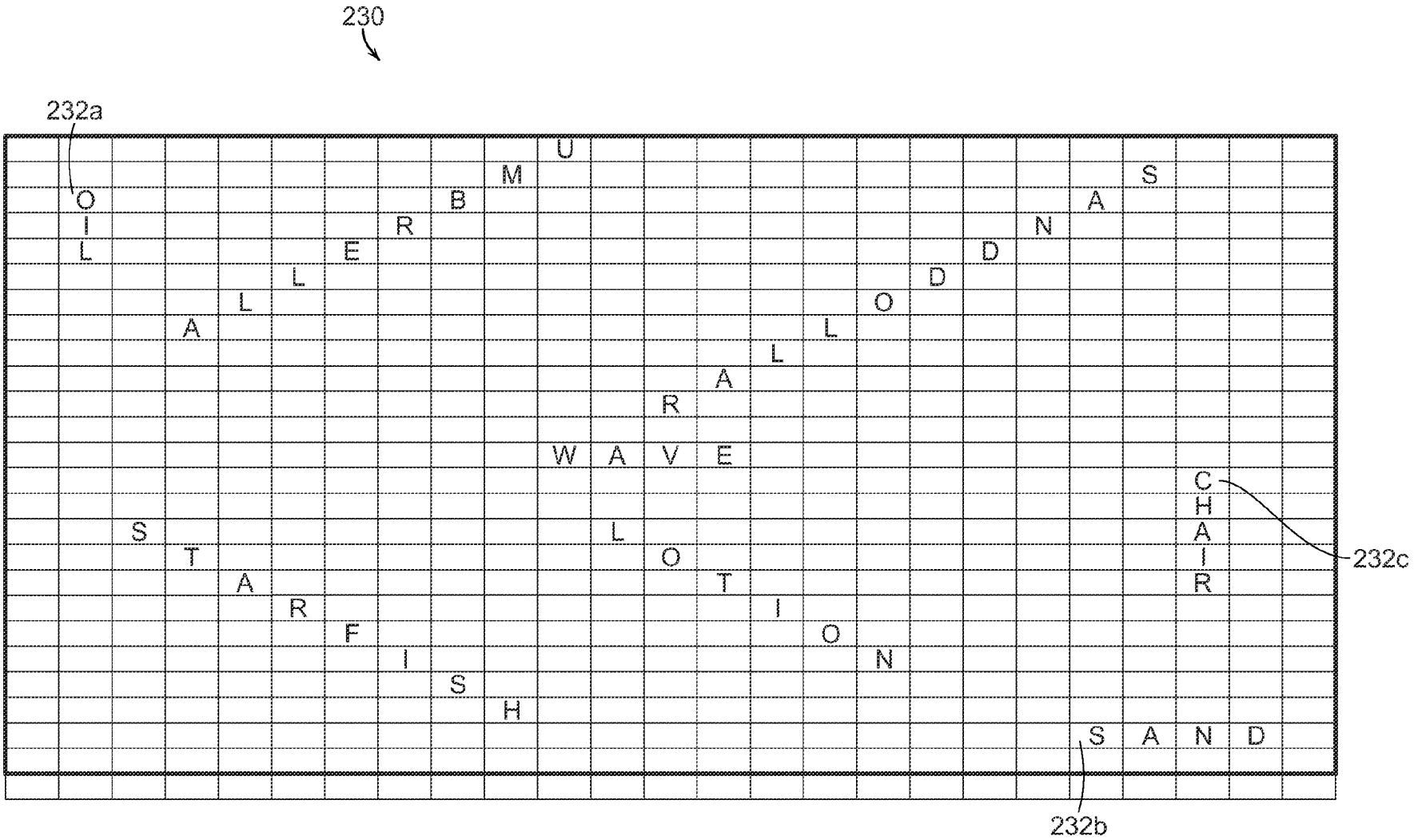
FIG. 19 is an illustration of an expose user interface, in accordance with principles of the invention.

In step 196 (FIG. 16), clue solutions (word clue solutions 62, word sequence clue solutions 92, numbered clue solutions 132, or other suitable solutions) for a puzzle are exposed without subgrid boundaries 32. For one embodiment that implements step 196, FIG. 19 is an illustration of an expose user interface (UI) 230 for a new puzzle, in accordance with principles of the invention. The expose UI 230 displays the clue solutions 62 from a new puzzle UI 220 as words (referred to generally as transposed words 232, such as transposed words 232*a*, 232*b*, and 232*c*). For example, the clue solution 62*a* ("OIL") from FIG. 18 is displayed as transposed word 232*a* in FIG. 19, which is transposed because the row and column positions are exchanged between FIG. 18 and FIG. 19. The expose UI 230 shows the transposed words 232 without the subgrid data and other unneeded data in preparation for Step 198 (FIG. 16). In one embodiment, the expose UI 230 has an Auto Get Transpose button that automatically gets words from the new puzzle UI 220. In another embodiment, the transposition procedure is not required, and the expose UI 230 is not provided.

Figure 20:
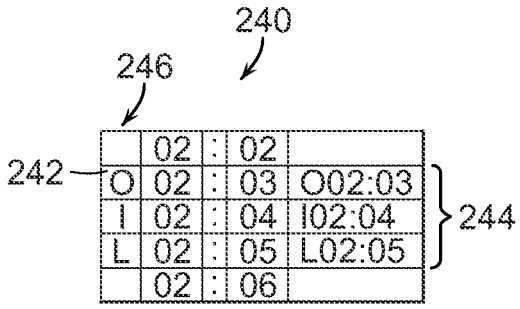
FIG. 20 is an illustration of a partial view of a word list converter user interface, in accordance with principles of the invention.
Figure 21:
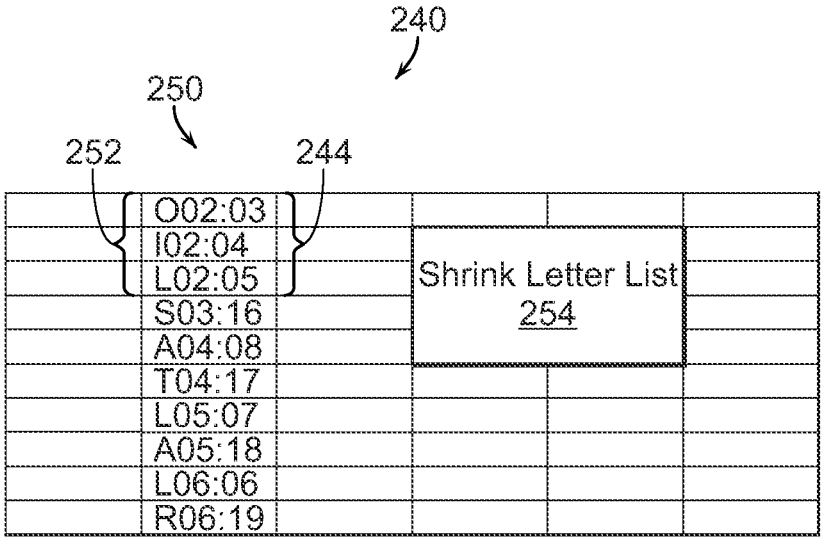
FIG. 21 is an illustration of a partial view of a compressed word list associated with the word list converter user interface of FIG. 20, in accordance with principles of the invention.

In step 198 (FIG. 16), the clue solutions (word clue solutions 62, word sequence clue solutions 92, numbered clue solutions 132, or other suitable solutions) are converted into a linear word list (for example, word list 250 in FIG. 21). For one embodiment that implements step 198, FIG. 20 is an illustration of a partial view of a word list converter user interface (UI) 240 for one word 242, in accordance with principles of the invention. The word list converter UI 240 displays a letter list 246 (shown in FIG. 20) based on the letters provided in the expose UI 230 (see FIG. 19). FIG. 20 depicts a word 242 ("OIL") in the letter list 246, which corresponds to transposed word 232*a* displayed in the expose UI 230 (see FIG. 19) and the clue solution 62*a* displayed in the new puzzle UI 220 (see FIG. 18). FIG. 20 depicts the grid locations 244 for the letter list word 242. For example, the letter "O" in the letter list word 242 has its location indicated in grid locations 244 by "02:03" which indicates row two and column three in the new puzzle UI 220 (see FIG. 18).

FIG. 21 is an illustration of a partial view of a compressed word list 250, in accordance with principles of the invention. For one embodiment that implements step 198, FIG. 21 displays a word 252 in a compressed word list 250, which is the word "OIL." The compressed word list 252 is a compressed version of the letter list 246 displayed in FIG. 20, with any blank locations removed. The Shrink Letter List button 254 of the word list converter UI 240 (shown in FIG. 21) is used to compress the letter list 246.

In step 200 (FIG. 16), the compressed word list 250 is provided to the puzzle generator. The compressed word list 250 created in the word list converter UI 240 is sent to a puzzle generator (in one embodiment, server 140 providing a puzzle generating function) to generate puzzle data intended for use in a finished puzzle (for example, puzzle solution 60, 100, and/or 130) based on the compressed word list 250. In one embodiment, a finished puzzle user interface 170 (using computer macros and/or programming code) uses the puzzle data to create the finished puzzle, and a corresponding starting puzzle (for example, puzzle grid 50, 80, and/or 120) see steps 202 and 204, FIG. 16. In other embodiments, the puzzle generating function is provided on the user device 160. The advantage of the compressed word list 250 is that a relatively small amount of data is required to be transferred, for example, for a user device 160. In one embodiment, the compressed word list 250 is an advantage if the user device 160 has limited memory or data storage size and/or the user device 160 has a slow or limited data transfer rate.

In the puzzle generation process, certain cells that are filled with characters 26 (for example, clue solution 62*a* in FIG. 18) are maintained as they are, and characters 26 are placed into other cells (empty cells 28) in the puzzle to produce filled cells 24 in a finished puzzle, according to the character singularity rules. In one embodiment of the puzzle generator process, a recursive program is used to fill in a character 26 in an empty cell 28. The recursive program evaluates the validity of the filled in character 26 in comparison to other characters 26 in previously filled cells already provided, using the character singularity rules. In various embodiments, the recursive program is included as part of the puzzle instruction set 146 of the server 140 or the UI instruction set 172 of a user device 160. In one embodiment, a checking program is used to located unintended words in a finished puzzle that may be considered inappropriate.

In step 202 (FIG. 16), a finished puzzle (word search puzzle solution 60, word sequence puzzle solution 100, numbered clue puzzle solution 130, or other puzzle solution) is produced based on output from the puzzle generator. In one embodiment, puzzle data (as a computer file or other output) is received from the puzzle generator (for example, from a server 140 providing the puzzle generation function), and used as input to a puzzle finishing process. In one embodiment, the puzzle finishing process is provided by spreadsheet macros and Visual Basic code to process the puzzle data to produce the filled-in finished puzzle matrix in spreadsheet format and starting puzzle grids (see step 204, FIG. 16).

In step 204 (FIG. 16), a set of starting puzzles (for example, word search puzzle grid 50, word sequence puzzle grid 80, or numbered clue puzzle grid 120) are generated with different degrees of difficulty. In one embodiment, a finished puzzle user interface is provided that includes a Make All Puzzles and Solutions button that is selected to process the output from the puzzle generation process. In one embodiment, the degrees of difficulty are indicated by the proportion of filled cells 24, such as 90%, 85%, 80%, 75%, 70%, 65%, 60%, or 55% filled cells 24 in the starting puzzle. More generally, a starting puzzle is characterized as easy, medium, or hard, in one embodiment.

In one embodiment, the limit for clue input is about 60 seed characters 26 (about 12 words). This limit for clue input is not meant to be limiting of the invention. In one embodiment, software developed according to the principles of the invention is in a testing phase, and more than thirty finished puzzles, each with multiple starting puzzles, have been produced. There are multiple starting puzzles, because the number of filled cells 24 in each starting puzzle can be varied (in one embodiment, ranging from 90% to 55%) thus affecting the difficulty level of the starting puzzle. The puzzles satisfy the dual sets of requirements described elsewhere herein, because some solution characters 42 in each finished puzzle are required to satisfy character singularity rules and simultaneously other requirements, such as being part of a set of solution characters (for example, a word 62). The dual sets of requirements of the invention are unexpected. It is not clear that there can be any expectation in advance that a finished puzzle solution is able to be successfully produced that meets the dual sets of requirements of the invention, because it is not clear in advance whether a computer program designed to produce a starting puzzle (for example, 50, 80, 120) would be able to produce a starting puzzle (for example 50, 80, 120) that would be considered a useful or successful puzzle, for example, if, for a given set of words, a solution cannot be found.

In one embodiment, the user interfaces 170 are implemented by a spreadsheet application, for example, the Microsoft® Excel® spreadsheet application along with spreadsheet macros and Visual Basic coding. In other embodiments, a use case analysis is done to develop the user interface 170 and other software related to the letter placement game to determine how a user may use the user interface 170. For example, how and where the user saves a file (for example, for an incompletely solved starting puzzle), and what levels of hints are provided to a player during the course of solving a starting puzzle.

In one embodiment, the user device 160 is a tablet computer. In various embodiments, a player using the tablet 160 pulls puzzles from a server 140 using a player user interface 170 displayed on the tablet 160. In one embodiment, a puzzle competition is established for a group of players, such as making a starting puzzle available at a set time from a server 140, and the first player to complete or solve the starting puzzle is declared the winner on a web site provided or supported by the server 140.

In one embodiment, data on each cell is stored on a user device 160. In one embodiment, each empty cell 28 has five to ten fields of data, thus allowing for the recording and saving of multiple possible solution characters 42 for that empty cell 28, as well as other relevant data. In various embodiments, such data include the solution character 42 for that cell 28, an indication that the empty cell 28 is part of a word (for example, clue solution 62), and/or other data. In another embodiment, such data is stored on a server 140 and transferred back and forth to a user device 160. In various embodiments, various amount and types of data per cell (empty cell 28 or filled cell 24) are provided.

While the invention has been shown and described with reference to specific preferred embodiments, it should be understood by those skilled in the art that various changes in form and detail may be made therein without departing from the spirit and scope of the invention as defined by the following claims.

In one embodiment, a user or player 162 of the letter placement game accesses the user interfaces 170 of FIGS. 17 through 21 (for example, user interfaces 210, 220, 230, and 240) to design his or her own puzzles. In a further embodiment, the user interfaces 170 of FIGS. 17 through 21 are modified or adapted to be more useable to the average user or player 162, who wishes to design his or her own puzzles. In other words, the user interface 170 of FIGS. 17 through 21 are not meant to be limited to the user interfaces 170 as depicted, but various user interfaces 170 are provided in various embodiments that provide the same or similar functions. For example, the user interfaces 170, in various embodiments, are combined or separated into various user interfaces 170, and are not required to follow the specific appearances and allocation of functions per user interface 170 as depicted, for example, in user interfaces 210, 220, 230, and 240 in FIGS. 17 through 21. In another example, the functions depicted in user interfaces 210, 220, 230, and 240 are automated, that is, performed by software, based on input of an initial set of clues and other input, such as the level of difficulty in the finished puzzle that is requested.

The size and shape of the cells, in various embodiments, is not limited to what is shown herein. Various sizes and geometric shapes can be used for the cells, as long as the character singularity rules described herein are followed.

In various embodiments, the letter placement game and related functions described herein can be implemented as hardware microchips, programmable microchips, embedded microchips and other forms of implementation.

In other embodiments, the predetermined set of characters is not required to be alphabetic, but can be implemented as a set of symbols, or set of images associated with a language (for example, pictographic language).

What is claimed is:

1. A letter placement game, comprising:

means for providing a puzzle grid having a plurality of cells, a plurality of horizontal rows, a plurality of vertical rows, and a plurality of subgrids, each subgrid, each horizontal row, and each vertical row having an equal number of cells;

means for providing a predetermined set of characters, the puzzle grid comprising filled cells, each filled cell comprising one of the characters, and the puzzle grid comprising empty cells, each empty cell associated with a predetermined solution character;

means for providing a set of character singularity rules requiring that (i) each horizontal row contains one set of the predetermined characters having one instance of each character, (ii) each vertical row contains one set of the predetermined characters having one instance of each character, and (iii) each subgrid contains one set of the predetermined characters having one instance of each character;

means for receiving clue input comprising a plurality of clues for a puzzle grid and means for receiving a request to generate a puzzle grid based on the plurality of clues, each clue having a solution to each clue based on the predetermined set of characters, each clue associated with a predetermined location in the puzzle grid, each predetermined location associated with a predetermined number of the cells, each predetermined location having a contiguous association of the cells of each predetermined location, each clue solution having a set of solution characters corresponding to the predetermined number of cells associated with each clue, each clue solution having a semantic meaning;

means for generating the puzzle grid based on the clue input and a puzzle solution for the puzzle grid, each character in each set of solution characters conforming to the character singularity rules, and each solution character for each empty cell conforming to the character singularity rules; and means for providing the puzzle grid and the puzzle solution in response to the request to generate the puzzle grid.

2. The game of claim 1, wherein the predetermined set of characters is based on an alphabet, and the plurality of clues are words.

3. The game of claim 1, wherein the predetermined set of characters is based on an alphabet, and the plurality of clues are based on words, each clue comprising a sequence of words.

4. The game of claim 1, wherein the predetermined set of characters is based on an alphabet, and each clue comprises one or more words providing a hint for each clue solution.

5. The game of claim 1, wherein the predetermined set of characters is based on an alphabet, and each clue comprises one or more word fragments providing a hint for each clue solution.

6. The game of claim 1, wherein the predetermined set of characters is based on an alphabet, and each clue comprises one or more words and one or more word fragments providing a hint for each clue solution.

7. The game of claim 1, wherein the predetermined set of characters is based on an alphabet, and one or more sets of solution characters comprise multiple instances of one character, requiring that each set of solution characters having the multiple instances of one character traverse one or more subgrid boundaries in order to satisfy the character singularity rules.

* * * * *